US006347858B1

(12) United States Patent
Faisst, Jr. et al.

(10) Patent No.: US 6,347,858 B1
(45) **Date of Patent: *Feb. 19, 2002**

(54) INK JET PRINTER WITH CLEANING MECHANISM AND METHOD OF ASSEMBLING SAME

(75) Inventors: Charles F. Faisst, Jr., Avon; Ravi Sharma, Fairport; Todd R. Griffin, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/195,727

(22) Filed: Nov. 18, 1998

(51) Int. Cl.[7] ..... B41J 2/165
(52) U.S. Cl. ..... 347/22; 347/28
(58) Field of Search ..... 347/22, 33, 31, 347/8, 93, 104, 28–29, 30

(56) References Cited

U.S. PATENT DOCUMENTS

| | | | | |
|---|---|---|---|---|
| 3,373,437 | A | 3/1968 | Sweet et al. | 347/75 |
| 3,416,153 | A | 12/1968 | Hertz et al. | 347/75 |
| 3,705,043 | A | 12/1972 | Zabiak | 106/22 |
| 3,776,642 | A | 12/1973 | Anson et al. | 356/188 |
| 3,846,141 | A | 11/1974 | Ostergren et al. | 106/22 |
| 3,870,528 | A | 3/1975 | Edds et al. | 106/22 |
| 3,878,519 | A | 4/1975 | Eaton | 347/75 |
| 3,889,269 | A | 6/1975 | Meyer et al. | 106/22 |
| 3,903,034 | A | 9/1975 | Zabiak et al. | 106/22 |
| 4,346,387 | A | 8/1982 | Hertz | 347/75 |
| 4,591,870 | A | 5/1986 | Braun et al. | 347/75 |
| 4,600,928 | A | 7/1986 | Braun et al. | 347/75 |
| 4,849,769 | A | 7/1989 | Dressler | 347/75 |
| 4,951,066 | A | 8/1990 | Teresawa et al. | 347/31 |
| 4,959,673 | A | 9/1990 | Noda | 347/33 |
| 4,970,535 | A | 11/1990 | Oswald et al. | 347/25 |

(List continued on next page.)

*Primary Examiner*—Anh T. N. Vo
(74) *Attorney, Agent, or Firm*—Walter S. Stevens; Roland R. Schindler, II

(57) ABSTRACT

An ink jet printer with cleaning mechanism, and method of assembling same. The printer comprises a print head having a surface thereon surrounding a plurality of ink ejection orifices. The orifices are in communication with respective ones of a plurality of ink channels formed in the print head. A vacuum hood capable of sealingly surrounding at least one of the orifices has having a first passageway therethrough capable of being disposed in communication with the orifice for vacuuming contaminant from the ink channel by way of the orifice. A solvent delivering wiper is connected to the hood and has a second passageway therethrough alignable with the surface. The second passageway delivers a liquid solvent to the surface to flush contaminant from the surface. Contaminant residing on the surface is entrained in the solvent while the wiper flushes contaminant from the surface. A vacuum canopy is connected to the wiper and has a third passageway therethrough alignable with the surface. The canopy vacuums the solvent and entrained contaminant from the surface. Moreover, a piping circuit is associated with the print head for filtering the particulate matter from the solvent and for recirculating clean solvent to the surface of the print head.

38 Claims, 16 Drawing Sheets

U.S. PATENT DOCUMENTS 5,115,250 A 5/1992 Harmon et al. ..... 347/33
5,148,746 A 9/1992 Fuller et al. ..... 101/142
5,151,715 A 9/1992 Ward et al. ..... 347/33
5,202,702 A 4/1993 Terasawa et al. ..... 347/24
5,210,550 A * 5/1993 Fisher et al. ..... 347/30
5,305,015 A 4/1994 Schantz et al. ..... 29/890.1
5,350,616 A 9/1994 Pan et al. ..... 428/131
5,396,271 A 3/1995 Premnath ..... 347/33
5,412,411 A * 5/1995 Anderson ..... 347/28
5,426,458 A 6/1995 Wenzel et al. ..... 347/45
5,431,722 A 7/1995 Yamashita et al. ..... 347/99
5,489,927 A 2/1996 Harmon ..... 347/33
5,500,660 A 3/1996 Childers et al. ..... 347/33
5,539,435 A 7/1996 Uchida et al. ..... 347/33
5,555,461 A 9/1996 Ackerman ..... 347/31
5,574,485 A * 11/1996 Anderson et al. ..... 347/27
5,583,548 A 12/1996 Kearns ..... 347/33
5,612,722 A 3/1997 Francis et al. ..... 347/33
5,614,930 A 3/1997 Osborne et al. ..... 347/33
5,683,187 A * 11/1997 Tunmore ..... 400/58
5,706,038 A 1/1998 Jackson et al. ..... 347/33
5,717,445 A 2/1998 Kida et al. ..... 347/33
5,725,647 A 3/1998 Carlson et al. ..... 106/31.86
5,738,716 A 4/1998 Santilli et al. ..... 106/31.77
5,745,133 A 4/1998 Hendricks et al. ..... 347/33
5,774,140 A 6/1998 English ..... 347/33
6,000,792 A * 12/1999 Koizumi et al. ..... 347/89
6,164,751 A * 12/2000 Griffin et al. ..... 347/28

* cited by examiner

INK JET PRINTER WITH CLEANING MECHANISM AND METHOD OF ASSEMBLING SAME

BACKGROUND OF THE INVENTION

This invention generally relates to ink jet printer apparatus and methods and more particularly relates to an ink jet printer with cleaning mechanism, and method of assembling same.

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

In this regard, "continuous" ink jet printers utilize electrostatic charging tunnels placed close to the point where ink droplets are being ejected in the form of a stream. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium.

In the case of "on demand" ink jet printers, at every orifice an actuator is used to produce the ink jet droplet. In this regard, either one of two types of actuators may be used. These two types of actuators are heat actuators and piezoelectric actuators. With respect to heat actuators, a heater placed at a convenient location heats the ink and a quantity of the ink will phase change into a gaseous steam bubble and raise the internal ink pressure sufficiently for an ink droplet to be expelled to the recording medium. With respect to piezoelectric actuators, a piezoelectric material is used, which piezoelectric material possess piezoelectric properties such that an electric field is produced when a mechanical stress is applied. The converse also holds true; that is, an applied electric field will produce a mechanical stress in the material. Some naturally occurring materials possessing these characteristics are quartz and tourmaline. The most commonly produced piezoelectric ceramics are lead zirconate titanate, lead metaniobate, lead titanate, and barium titanate.

Inks for high speed ink jet printers, whether of the "continuous" or "piezoelectric" type, have a number of special characteristics. For example, the ink should incorporate a nondrying characteristic, so that drying of ink in the ink ejection chamber is hindered or slowed to such a state that by occasional spitting of ink droplets, the cavities and corresponding orifices are kept open. The addition of glycol facilitates free flow of ink through the ink jet chamber.

Of course, the ink jet print head is exposed to the environment where the ink jet printing occurs. Thus, the previously mentioned orifices are exposed to many kinds of air born particulates. Particulate debris may accumulate on surfaces formed around the orifices and may accumulate in the orifices and chambers themselves. That is, the ink may combine with such particulate debris to form an interference burr that blocks the orifice or that alters surface wetting to inhibit proper formation of the ink droplet. Also, the ink may simply dry-out and form hardened deposits on the print head surface and in the ink channels. The particulate debris and deposits should be cleaned from the surface and orifice to restore proper droplet formation. In the prior art, this cleaning is commonly accomplished by brushing, wiping, spraying, vacuum suction or spitting of ink through the orifice.

Thus, inks used in ink jet printers can be said to have the following problems: the inks tend to dry-out in and around the orifices resulting in clogging of the orifices; the wiping of the orifice plate causes wear on plate and wiper and the wiper itself produces particles that clog the orifice; cleaning cycles are time consuming and slow productivity of ink jet printers. Moreover, printing rate declines in large format printing where frequent cleaning cycles interrupt the printing of an image. Printing rate also declines in the case when a special printing pattern is initiated to compensate for plugged or badly performing orifices.

Ink jet print head cleaners are known. A wiping system for ink jet print heads is disclosed in U.S. Pat. No. 5,614,930 titled "Orthogonal Rotary Wiping System For Inkjet Printheads" issued Mar. 25, 1997 in the name of William S. Osborne et al. This patent discloses a rotary service station that has a wiper supporting tumbler. The tumbler rotates to wipe the print head along a length of linearly aligned nozzles. In addition, a wiper scraping system scrapes the wipers to clean the wipers. However, Osborne et al. do not disclose use of an external solvent to assist cleaning and also do not disclose complete removal of the external solvent.

Therefore, there is a need to provide a suitable ink jet printer with cleaning mechanism, and method of assembling same, which cleaning mechanism is capable of simultaneously cleaning the print head surface and ink channels.

SUMMARY OF THE INVENTION

An object of the present invention is to provide an ink jet printer with cleaning mechanism and method of assembling same, which cleaning mechanism simultaneously cleans a surface of a print head belonging to the printer as the cleaning mechanism cleans ink channels formed in the print head.

With the above object in view, the invention resides in an ink jet printer, comprising a print head having a surface thereon and an ink channel therein; and a cleaning mechanism associated with said print head and adapted to simultaneously clean contaminant from the surface and the ink channel.

According to an exemplary embodiment of the invention, an ink jet printer comprises a print head having a surface thereon surrounding a plurality of ink ejection orifices. The orifices are in communication with respective ones of a plurality of ink channels formed in the print head. A vacuum hood capable of sealingly surrounding at least one of the orifices has a first passageway formed therethrough in communication with the orifice. The hood vacuums contaminant from the ink channels in communication with the orifice. A solvent delivering wiper is connected to the hood and has a second passageway formed therethrough alignable with the print head surface. The second passageway delivers a liquid solvent cleaning agent to the print head surface to flush contaminant from the surface. In this manner, contaminant residing on the surface is entrained in the solvent while the wiper flushes contaminant from the surface. A vacuum canopy is connected to the wiper and has a third passageway formed therethrough alignable with the surface. The purpose of the canopy is to vacuum solvent and entrained contaminant from the print head surface. Moreover, a piping circuit is provided for filtering the particulate matter from the solvent and for recirculating clean solvent to the surface of the print head.

In addition, a translation mechanism is connected to the hood, the wiper and the canopy for translating the hood, the wiper and the canopy across the print head surface. In this regard, the translation mechanism may comprise a lead-screw threadably engaging the hood, the wiper and/or the canopy. Moreover, a displacement mechanism is connected to the hood, the wiper and the canopy for displacing the hood, the wiper and the canopy to a position proximate the surface of the print head to enable cleaning of the ink channels and the surface of the print head.

A feature of the present invention is the provision of a cleaning mechanism associated with the print head, which cleaning mechanism is adapted to simultaneously clean contaminant from the print head surface and ink channels.

An advantage of the present invention is that cleaning time is reduced because the print head surface and ink channels are cleaned simultaneously.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will better understood from the following detailed description when taken in conjunction with the accompanying drawings wherein:

FIG. 8B1 is a view in vertical section showing a wiping mode and scrape and lift mode as a function of contact angle between wiper blade and print head;

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
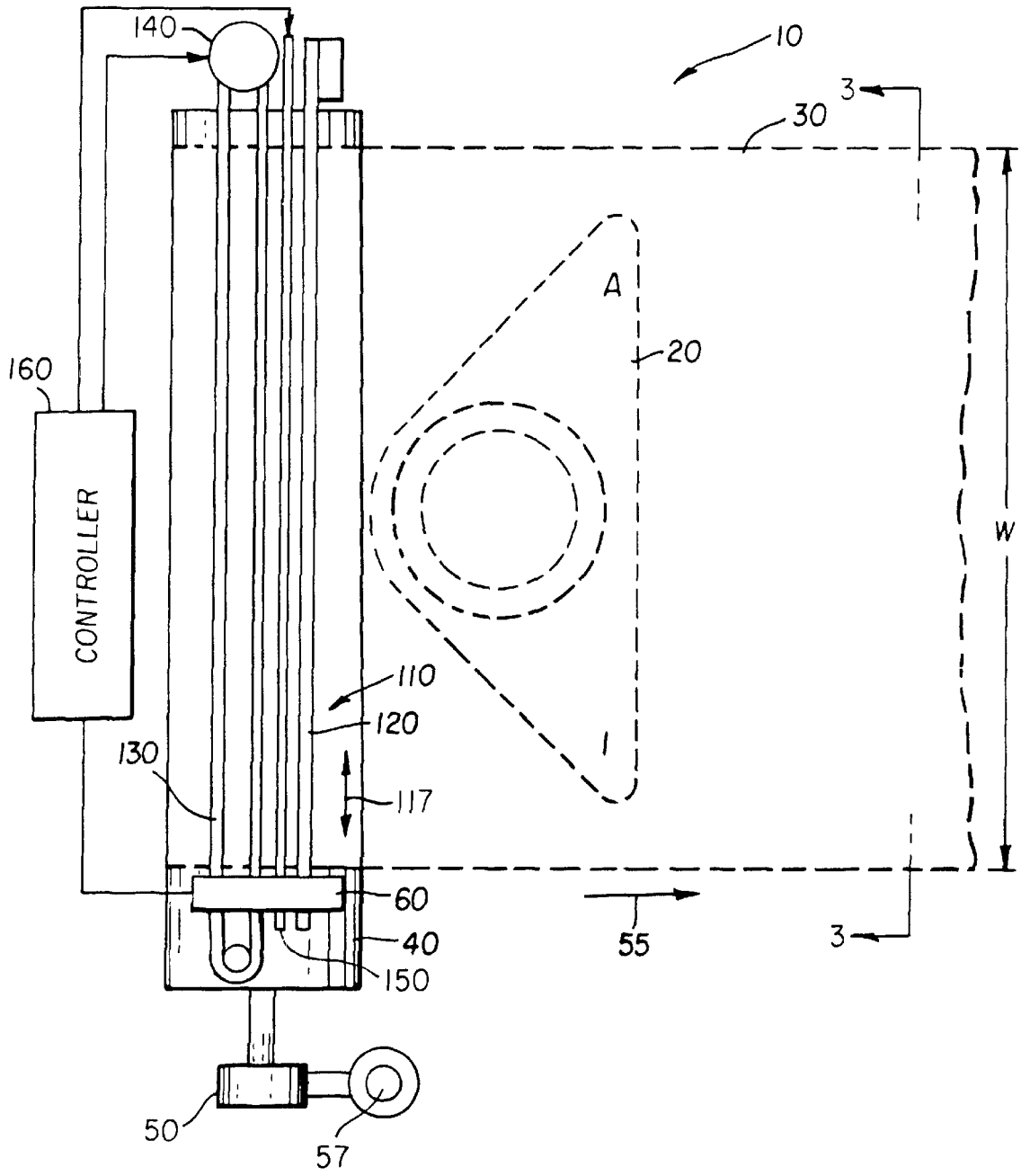
FIG. 1 is a view in plan of a first embodiment ink jet printer, the printer having a reciprocating print head and a pivotable platen roller disposed adjacent the print head.
Figure 2:
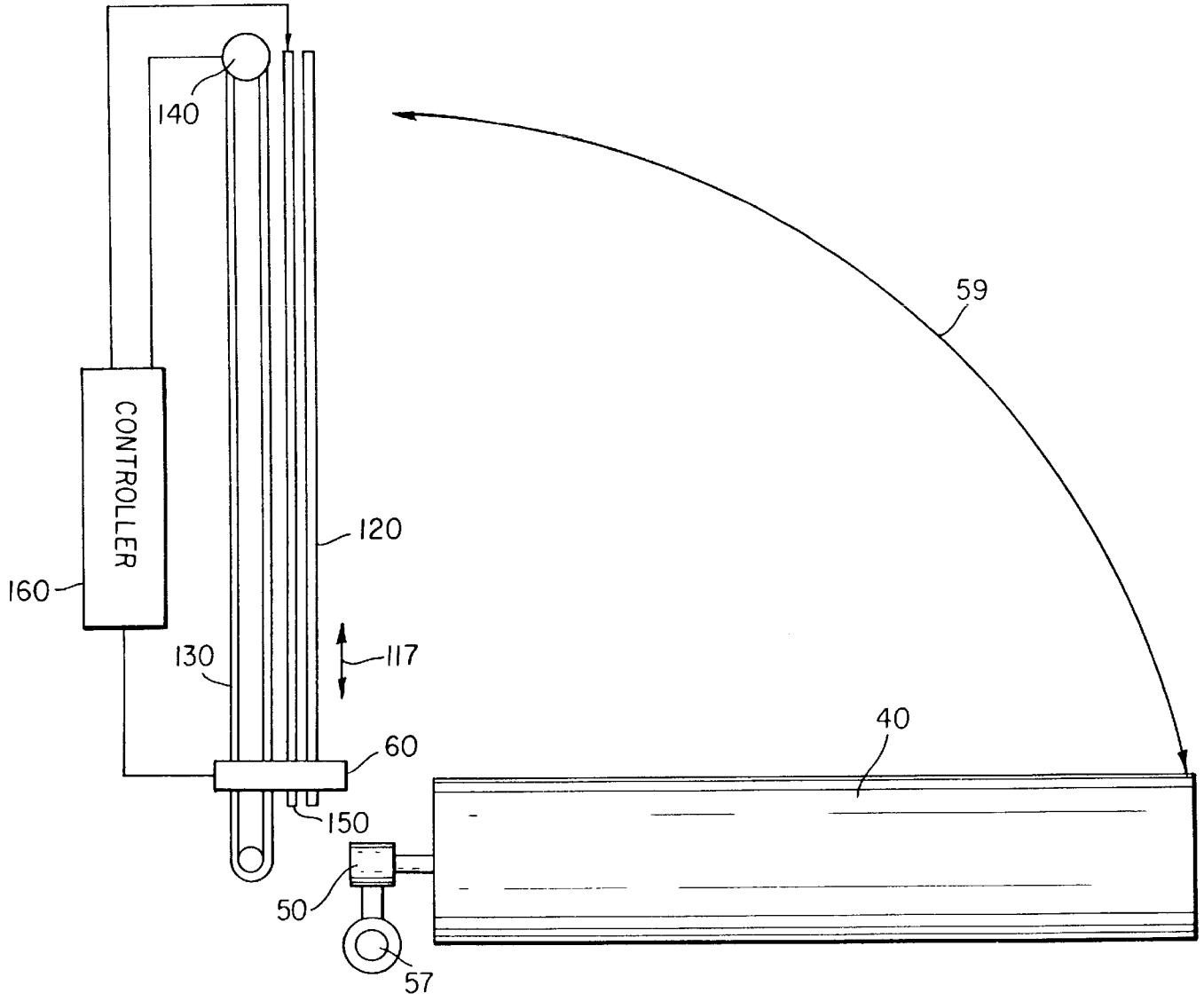
FIG. 2 is a view in plan of the first embodiment of the printer showing the pivotable platen roller pivoting in an arc outwardly from the print head.

Therefore, referring to FIGS. 1 and 2, there is shown a first embodiment ink jet printer, generally referred to as 10, for printing an image 20 (shown in phantom) on a receiver 30 (also shown in phantom), which may be a reflective-type receiver (e.g., paper) or a transmissive-type receiver (e.g., transparency). Receiver 30 is supported on a platen roller 40 capable of being rotated by a platen roller motor 50 engaging platen roller 40. Thus, when platen roller motor 50 rotates platen roller 40, receiver 30 will advance in a direction illustrated by a first arrow 55. Platen roller 40 is adapted to pivot outwardly about a pivot shaft 57 along an arc 59 for reasons disclosed hereinbelow. Many designs for feeding paper for printing are possible. Another mechanism utilizes a first set of feed rollers to dispose receiver 30 onto a plate for printing. A second set of feed rollers remove the receiver 30 when printing is completed.

Figure 3:
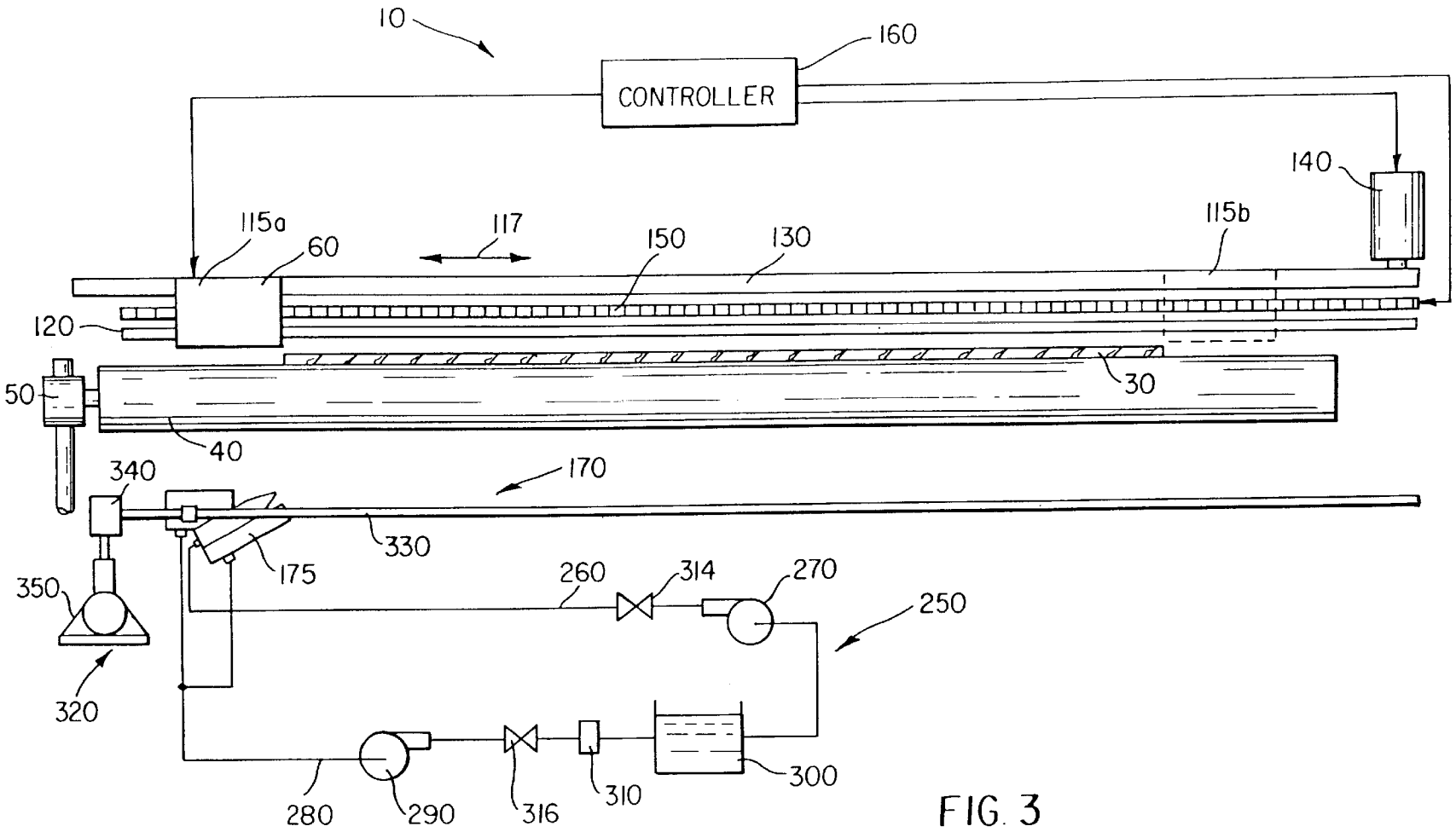
FIG. 3 is a view taken along section line 3—3 of FIG. 1, this view showing a cleaning mechanism poised to move to a position adjacent the print head to clean the print head.
Figure 4:
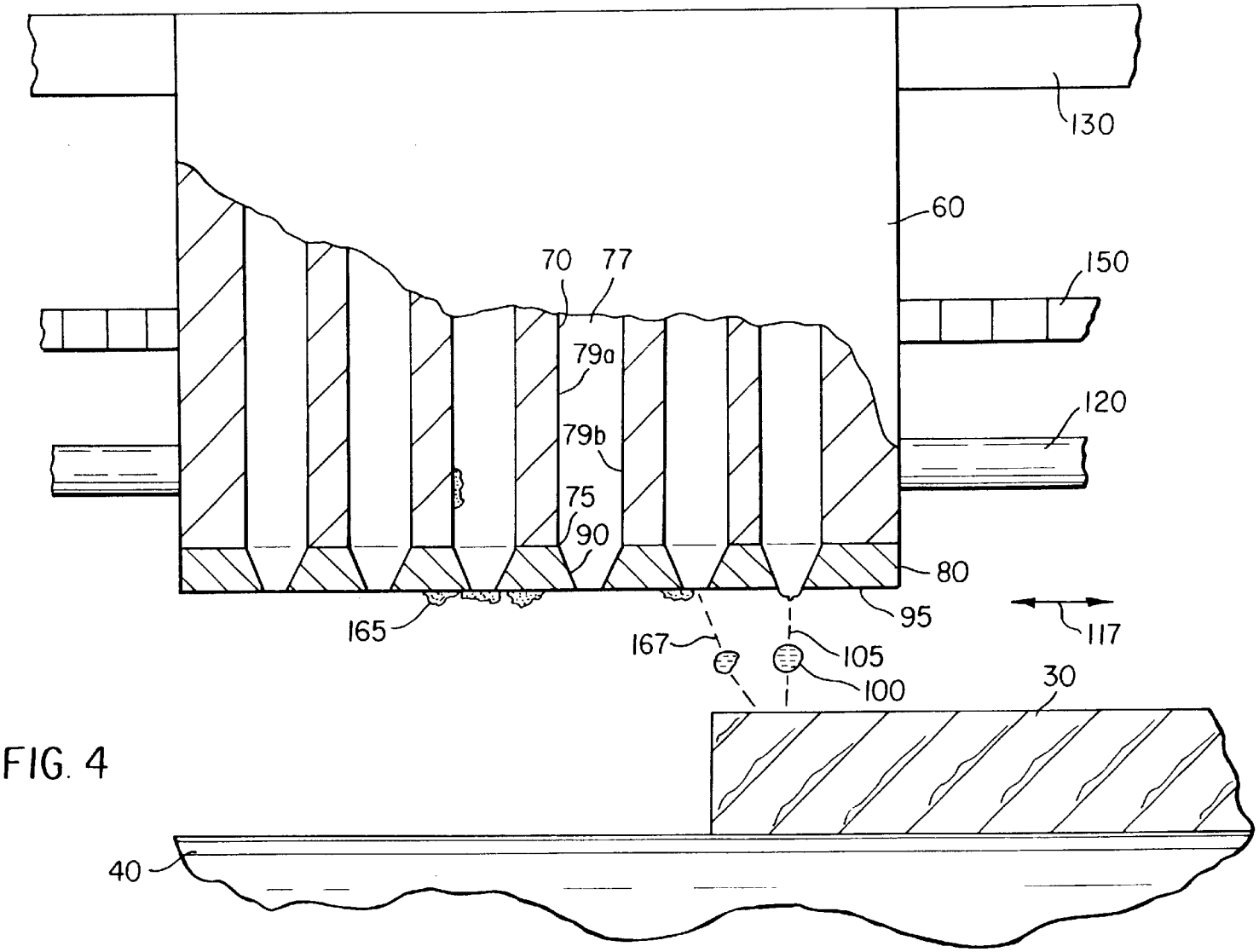
FIG. 4 is a view in partial elevation of the print head and adjacent platen roller.

Referring to FIGS. 1, 3 and 4, printer 10 also comprises a reciprocating print head 60 disposed adjacent to platen roller 40. Print head 60 includes a plurality of ink channels 70 formed therein (only six of which are shown), each channel 70 terminating in a channel outlet 75. In addition, each channel 70, which is adapted to hold an ink body 77 therein, is defined by a pair of oppositely disposed parallel side walls 79*a* and 79*b*. Print head 60 may further include a cover plate 80 having a plurality of orifices 90 formed therethrough colinearly aligned with respective ones of channel outlets 75, such that each orifice 90 faces receiver 30. A surface 95 of cover plate 80 surrounds all orifices 90 and also faces receiver 30. Of course, in order to print image 20 on receiver 30, an ink droplet 100 is released from ink channel 70 through orifice 90 in direction of receiver 30 along a preferred axis 105 normal to surface 95, so that droplet 100 is suitably intercepted by receiver 30. To achieve this result, print head 60 may be a "piezoelectric ink jet" print head formed of a piezoelectric material, such as lead zirconium titanate (PZT). Such a piezoelectric material is mechanically responsive to electrical stimuli so that side walls 79*a*/*b* simultaneously inwardly deform when electrically stimulated. When side walls 79*a*/*b* simultaneously inwardly deform, volume of channel 70 decreases to squeeze ink droplet 100 from channel 70 and through orifice 90.

Referring again to FIGS. 1, 3 and 4, a transport mechanism, generally referred to as 110, is connected to print head 60 for reciprocating print head 60 between a first position 115*a* thereof and a second position 115*b* (shown in phantom). In this regard, transport mechanism 110 reciprocates print head 60 in direction of a second arrow 117. Print head 60 slidably engages an elongate guide rail 120, which guides print head 60 parallel to platen roller 40 while print head 60 is reciprocated. Transport mechanism 110 also comprises a drive belt 130 attached to print head 60 for reciprocating print head 60 between first position 115*a* and second position 115*b*, as described presently. In this regard, a reversible drive belt motor 140 engages belt 130, such that belt 130 reciprocates in order that print head 60 reciprocates with respect to platen 40. Moreover, an encoder strip 150 coupled to print head 60 monitors position of print head 60 as print head 60 reciprocates between first position 115*a* and second position 115*b*. In addition, a controller 160 is connected to platen roller motor 50, drive belt motor 140, encoder strip 150 and print head 60 for controlling operation thereof to suitably form image 20 on receiver 30. Such a controller may be a Model CompuMotor controller available from Parker Hannifin, Incorporated located in Rohnert Park, Calif.

As best seen in FIG. 4, it has been observed that surface 95 may have contaminant thereon, such as particulate matter 165. Such particulate matter 165 also may partially or completely obstruct orifice 90. Particulate matter 165 may be, for example, particles of dirt, dust, metal and/or encrustations of dried ink. The contaminant may also be an unwanted film (e.g., grease, oxide, or the like). Although the description herein refers to particulate matter, it is to be understood that the invention pertains to such unwanted film, as well. Presence of particulate matter 165 is undesirable because when particulate matter 165 completely obstructs orifice 90, ink droplet 100 is prevented from being ejected from orifice 90. Also, when particulate matter 165 partially obstructs orifice 90, flight of ink droplet 105 may be diverted from preferred axis 105 to travel along a non-preferred axis 167 (as shown). If ink droplet 100 travels along non-preferred axis 167, ink droplet 100 will land on receiver 30 in an unintended location. In this manner, such complete or partial obstruction of orifice 90 leads to printing artifacts such as "banding", a highly undesirable result. Also, presence of particulate matter 165 on surface 95 may alter surface wetting and inhibit proper formation of droplet 100. Therefore, it is desirable to clean (i.e., remove) particulate matter 165 to avoid printing artifacts and improper formation of droplet 100.

Therefore, referring to FIGS. 3, 5, 6, 7 and 8A, a first embodiment cleaning mechanism, generally referred to as 170, is associated with print head 60. As described in detail hereinbelow, cleaning mechanism 170 is adapted to simultaneously clean particulate matter 165 from surface 95 and ink channel 70. More specifically, cleaning mechanism comprises a first embodiment cleaning block 175 that includes a vacuum hood 180 having a first passageway 190 formed therethrough in communication with at least one of orifices 90. Surrounding an edge 195 circumscribing hood 180 may be an elastomeric seal 200 capable of sealingly engaging surface 95 for forming a leak-tight seal between surface 95 and hood 180. Alternatively, seal 200 may be absent while hood 180 nonetheless sealingly engages surface 95. That is, hood 180 may itself be formed of pliable elastic material, such as an open-cell polyurethane foam, which may be "PORON™" available from Rogers, Incorporated located in Rogers, Conn. As another alternative, hood 180 itself may be formed of elastomers, felt, cellulosic fibers or "skinned" porous foam. However, with respect to the preferred embodiment, it may be understood that negative pressure applied to sealingly engage seal 200 with surface 95 could be optimized to allow movement of cleaning block 175 across surface 95 while the leak-tight seal is maintained. For example, cleaning block 175 may be caused to have intermittent motion such that cleaning block 175 wipes a portion of surface 95 and then stops. At this point, a predetermined higher vacuum is applied to hood 180 to suitably vacuum particulate matter 165 from some channels 70. After particulate matter 165 is vacuumed from these channels 70, the higher vacuum is reduced and cleaning block 175 is moved a distance "L" to another portion of surface 95 to clean this other portion of surface 95 and other channels 70. In this manner, a smooth cleaning motion is obtained for cleaning block 175 as cleaning block 175 traverses surface 95. This "stop and vacuum" technique is repeated until all desired portions of surface 95 and all desired channels 70 are cleaned.

Referring again to FIGS. 3, 5, 6, 7 and 8A, first embodiment cleaning block 175 further includes a solvent delivering wiper 210 connected to hood 180. Wiper 210 has a second passageway 220 formed therethrough. Solvent delivering wiper 210 is oriented with respect to surface 95 such that second passageway 220 is alignable with surface 95 for reasons disclosed presently. In this regard, second passageway 220 is alignable with surface 95 for delivering a liquid solvent cleaning agent to surface. 95 in order to flush particulate matter 165 from surface 95 (as shown). Of course, particulate matter 165 will be entrained in the solvent as the solvent flushes particulate matter 165 from surface 95. Moreover, wiper 210 is connected to hood 180 by any suitable means known in the art, such as by a screw fastener (not shown). Wiper 210 may also include a blade portion 225 integrally formed therewith for lifting contaminant 165 from surface 95 as cleaning block 175 traverses surface 95 in direction of a third arrow 227. It may be understood that previously mentioned seal 200 on hood 180 in combination with vacuum pump 290 co-act to remove solvent and particulate matter 165 which may have been left by blade portion 225 as blade portion 225 traverses surface 95 (as shown). In addition, cleaning block 175 also includes a vacuum canopy 230 connected to wiper 210. Canopy 230 has a third passageway 240 formed therethrough. Canopy 230 is oriented with respect to surface 95 such that third passageway 240 is alignable with surface 95 for vacuuming the solvent and entrained particulate matter 165 from surface 95 (as shown). Moreover, canopy 230 is connected to wiper 210 by any suitable means known in the art, such as by a screw fastener (not shown).

Figure 8:
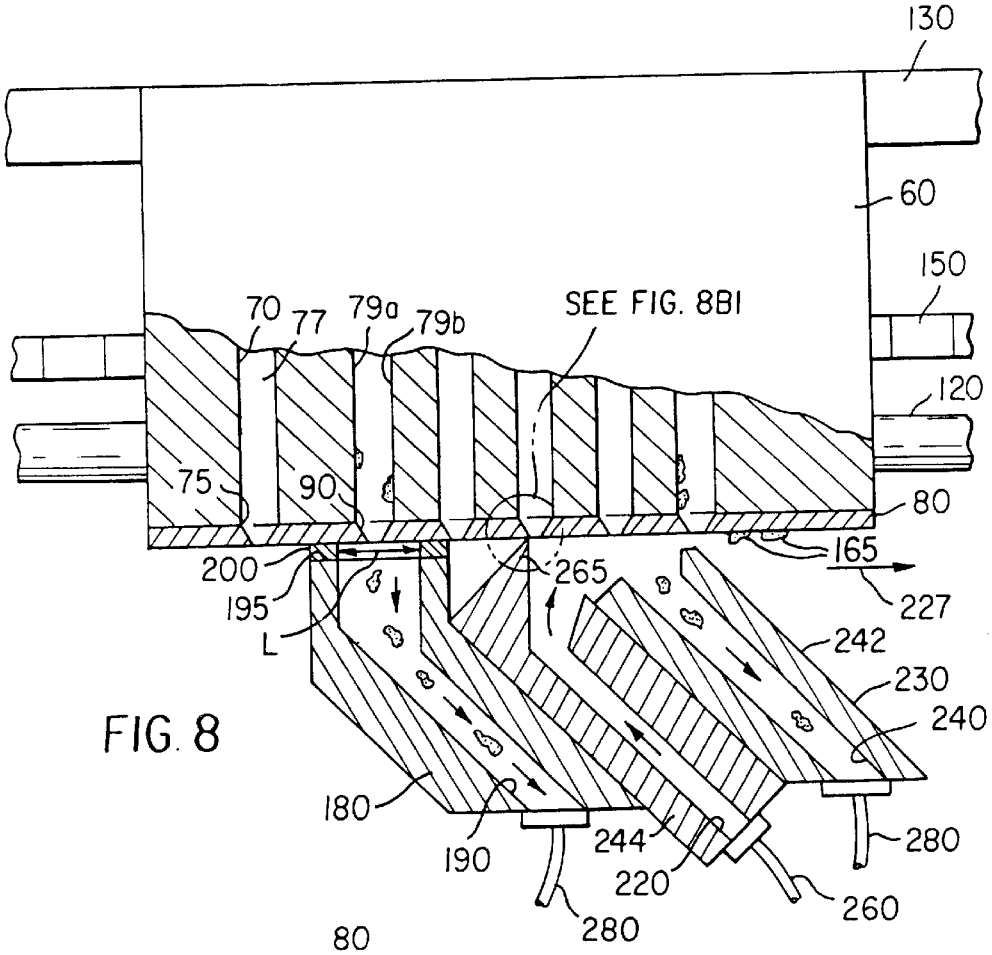
FIG. 8 is a view in vertical section of a second embodiment cleaning block while the second embodiment cleaning block cleans the print head.
Figure 8B:
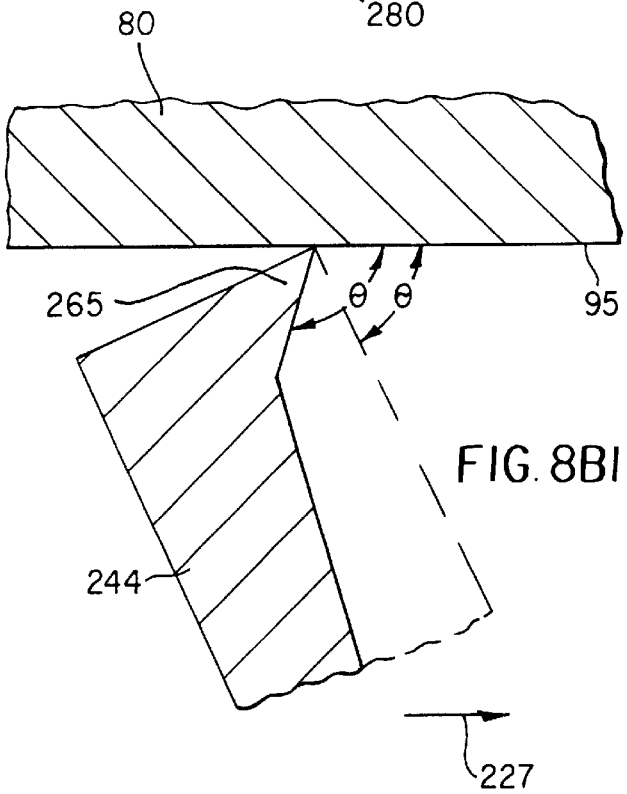
Figure 8A:
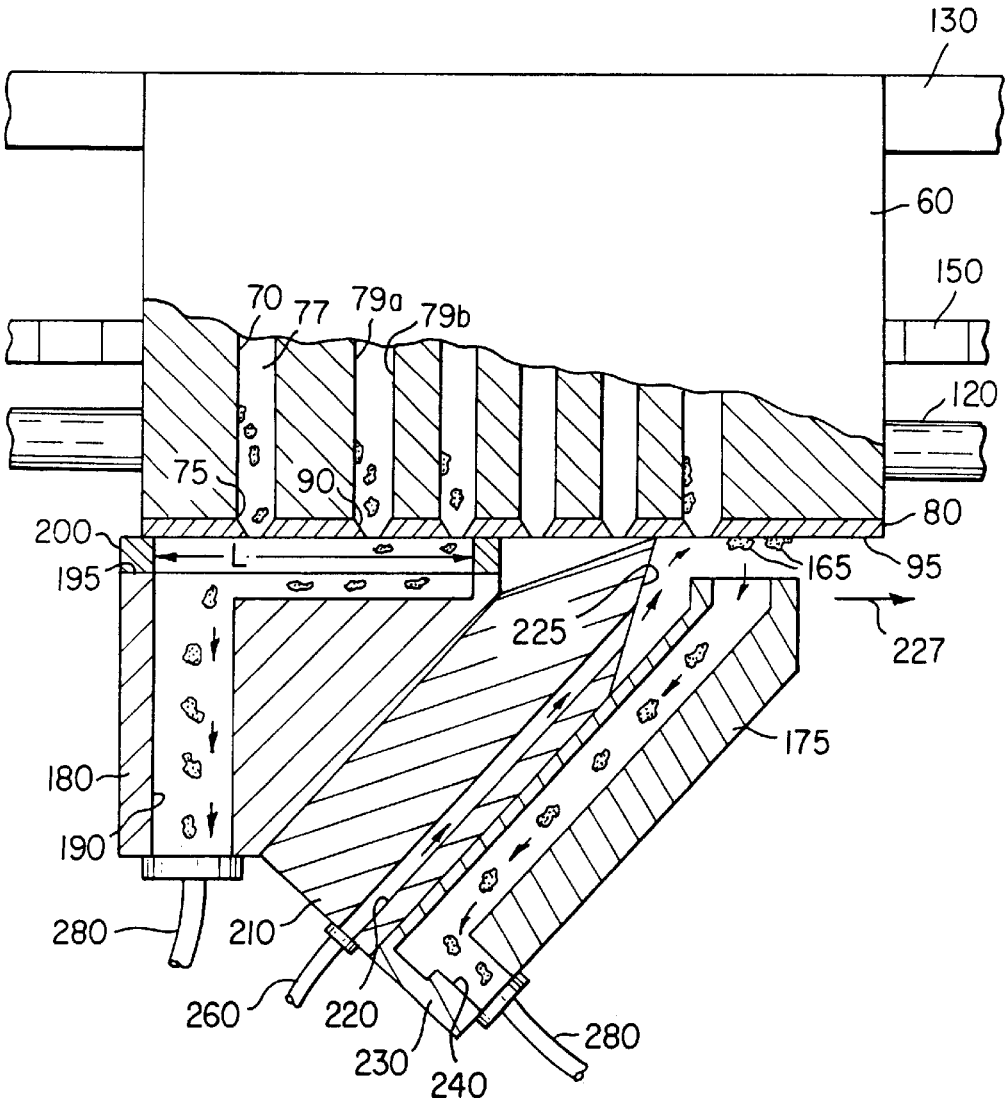
FIG. 8A is a view in vertical section of the first embodiment cleaning block while the first embodiment cleaning block cleans the print head.

As best seen in FIGS. 8 and 8B1, a second embodiment cleaning block 242 includes a solvent delivering squeegee 244 connected to hood 180. Squeegee 244 has previously mentioned second passageway 220 formed therethrough. Solvent delivering squeegee 244 is oriented with respect to surface 95 such that second passageway 220 is alignable with surface 95 for reasons disclosed presently. In this regard, second passageway 220 is alignable with surface 95 for delivering a liquid solvent cleaning agent to surface 95 in order to flush particulate matter 165 from surface 95 (as shown). Of course, particulate matter 165 will be entrained in the solvent as the solvent flushes particulate matter 165 from surface 95. As squeegee 244 traverses surface 95 in direction of third arrow 227, squeegee 244 will wipe (rather than scrape/lift) solvent and particulate matter film 165 from surface 95, which residual solvent and particulate matter film 165 will be vacuumed into previously mentioned third passageway 240. As seen in FIG. 8B1, wiping mode is defined as having contact angle θ of squeegee 244 less than 90 degrees with respect to print head surface 95. Scrape and lift mode is defined as having contact angle θ of squeegee 244 greater than 90 degrees with respect to print head surface 95. Squeegee 244 includes a wiper portion 246 integrally formed therewith for wiping particulate matter film 165 from surface 95 as cleaning block 242 traverses surface 95 in direction of third arrow 227. Moreover, squeegee 244 is connected to hood 180 by any suitable means known in the art, such as by a screw fastener (not shown). In addition, cleaning block 242 also includes previously mentioned vacuum canopy 230 connected to squeegee 244. Canopy 230 has third passageway 240 formed therethrough. Canopy 230 is oriented with respect to surface 95 such that third passageway 240 is alignable with surface 95 for vacuuming the solvent and entrained particulate matter film 165 from surface 95. Moreover, canopy 230 is connected to squeegee 244 by any suitable means known in the art, such as by a suitable screw fastener (not shown).

Returning to FIGS. 3, 5, 6, 7 and 8A, a piping circuit, generally referred to as 250, is associated with print head 60 for reasons disclosed momentarily. In this regard, piping circuit 250 includes a first piping segment 260 coupled to second passageway 220 formed through wiper 210. A discharge pump 270 is connected to first piping segment 260 for discharging the solvent into first piping segment 260. In this manner, the solvent discharges into second passageway 220 and onto surface 95 while discharge pump 270 discharges the solvent into first piping segment 260. It may be appreciated that the solvent discharged onto surface 95 is chosen such that the solvent also, at least in part, acts as lubricant to lubricate surface 95. Surface 95 is lubricated in this manner, so that previously mentioned blade portion 225 will not substantially mar, scar, or otherwise damage surface 95 and any electrical circuitry which may be present on surface 95. In addition, a second piping segment 280 is coupled to first passageway 190 formed through hood 180. Second piping segment 280 is also coupled to third passageway 240 formed through canopy 230. A vacuum pump 290 is connected to second piping segment 280 for inducing negative pressure (i.e., pressure less than atmospheric pressure) in second piping segment 280. Thus, negative pressure is simultaneously induced in first passageway 190 and third passageway 240 while vacuum pump 290 induces negative pressure in second piping segment 280. In this manner, negative pressure is induced in any of ink channels 70 in communication with first passageway 190. As negative pressure is induced in these ink channels 70, contaminant 165 is vacuumed from ink channels 70 and through corresponding orifices 90 to thereafter enter first passageway 190. As described hereinabove, negative pressure is induced in third passageway 240 while vacuum pump 290 induces negative pressure in second segment 280. Thus, negative pressure is induced on surface 95, which is aligned with third passageway 240, while vacuum pump 290 induces negative pressure in third passageway 240. As negative pressure is induced on surface 95, the solvent and entrained particulate matter 165 are vacuumed from surface 95 to enter third passageway 240.

Referring yet again to FIGS. 3, 5, 6, 7 and 8A, interposed between first piping segment 260 and second piping segment 280 is a solvent supply reservoir 300 having a supply of the solvent therein. Discharge pump 270, which is connected to first piping segment 260, draws the solvent from reservoir 300 and discharges the solvent into second passageway 220 by means of second piping circuit 260. Hence, it may be appreciated that first piping circuit 260 extends from wiper 210 to reservoir 300. In addition, vacuum pump 290, which is connected to second piping segment 280, pumps the solvent and particulate matter 165 from ink channel 70 toward reservoir 300. Also, vacuum pump 290 pumps the solvent and particulate matter 165 from surface 95 toward reservoir 300. Hence, it may be appreciated that second piping circuit 280 extends both from hood 180 and canopy 230 to reservoir 300. However, connected to second piping segment 280 and interposed between vacuum pump 290 and reservoir 300 is a filter 310 for capturing (i.e., separating-out) particulate matter 165 from the solvent, so that the solvent supply in reservoir 300 is free of particulate matter 165. Of course, when filter 310 becomes saturated with particulate matter 165, filter 310 is replaced by an operator of printer 10. Thus, circuit 250 defines a recirculation loop for recirculating contaminant-free solvent across surface 95 to efficiently clean surface 95. In addition, connected to first segment 260 is a first valve 314, which first valve 314 is interposed between wiper 210 and discharge pump 270. Moreover, connected to second segment 280 is a second valve 316, which second valve 316 is interposed between hood 180 and vacuum pump 290. Presence of first valve 314 and second valve 316 make it more convenient to perform maintenance on cleaning mechanism 170. That is, first valve 314 and second valve 316 allow cleaning mechanism 170 to be easily taken out-of service for maintenance. For example, to replace filter 310, discharge pump 270 is shut-off and first valve 314 is closed. Vacuum pump 290 is operated until solvent and particulate matter 165 are substantially evacuated from second piping segment 280. At this point, second valve 316 is closed and vacuum pump 290 is shut-off. Next, saturated filter 310 is replaced with a clean filter 310. Thereafter, cleaning mechanism 170 is returned to service substantially in reverse to steps used to take cleaning mechanism 170 out-of service.

Still referring to FIGS. 3, 5, 6, 7 and 8A, a translation mechanism, generally referred to as 320, is connected to cleaning block 175 for translating cleaning block 175 across surface 95 of print head 60. In this regard, translation mechanism 320 comprises an elongate externally threaded lead-screw 330 threadably engaging cleaning block 170. Engaging lead-screw 330 is a motor 340 capable of rotating lead-screw 330, so that cleaning block 175 traverses surface 95 as lead-screw 330 rotates. In this regard, cleaning block 175 traverses surface 95 in direction of a fourth arrow 345. In addition, cleaning block 175 is capable of being translated to any location on lead-screw 330, which preferably extends the length of guide rail 120. Being able to translate cleaning block 175 to any location on lead-screw 330 allows cleaning block 175 to clean print head 60 wherever print head 60 is located on guide rail 120. Moreover, connected to motor 340 is a displacement mechanism 350 for displacing cleaning block 175 to a position proximate surface 95 of print head 60.

Figure 5:
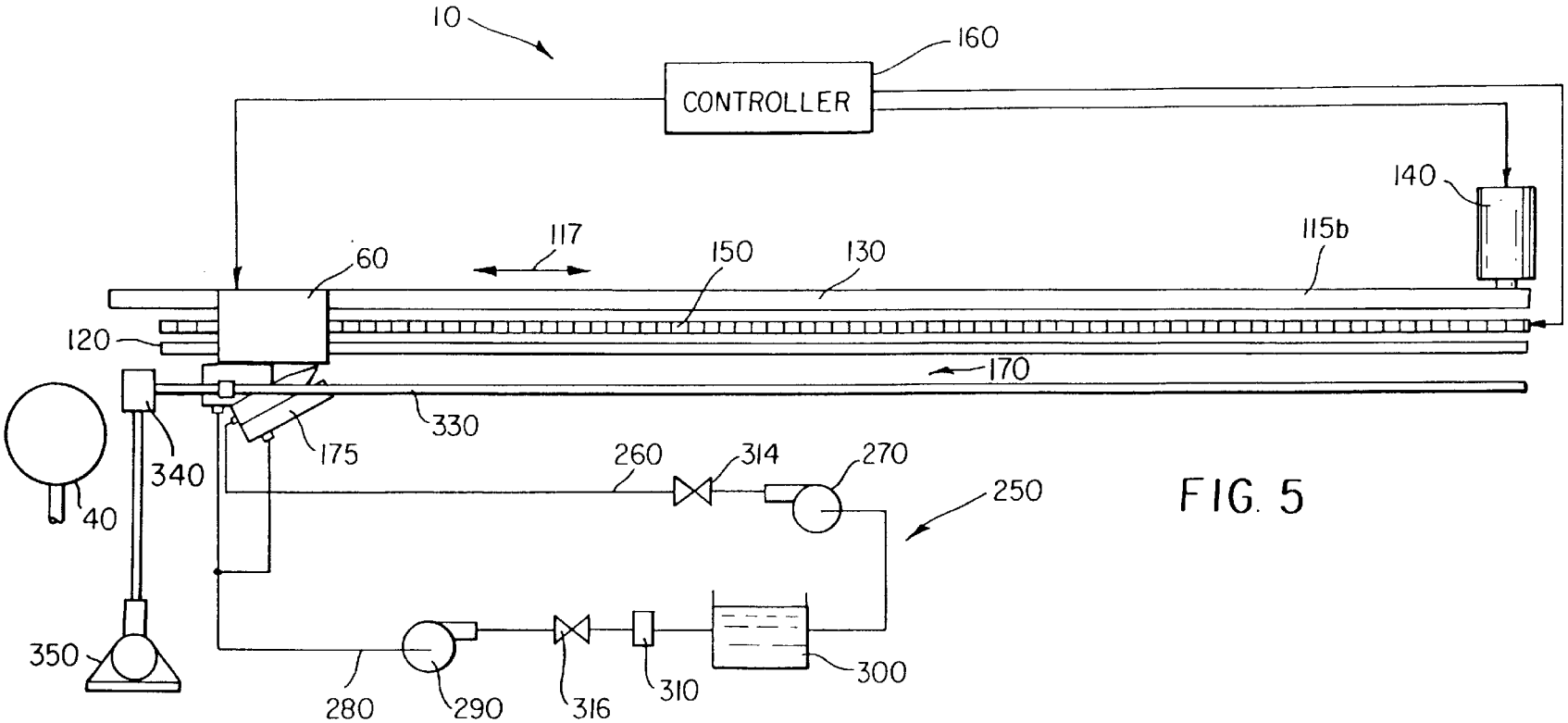
FIG. 5 is a view in elevation of the first embodiment printer, this view showing the cleaning mechanism having been moved into position to clean the print head.
Figure 6:
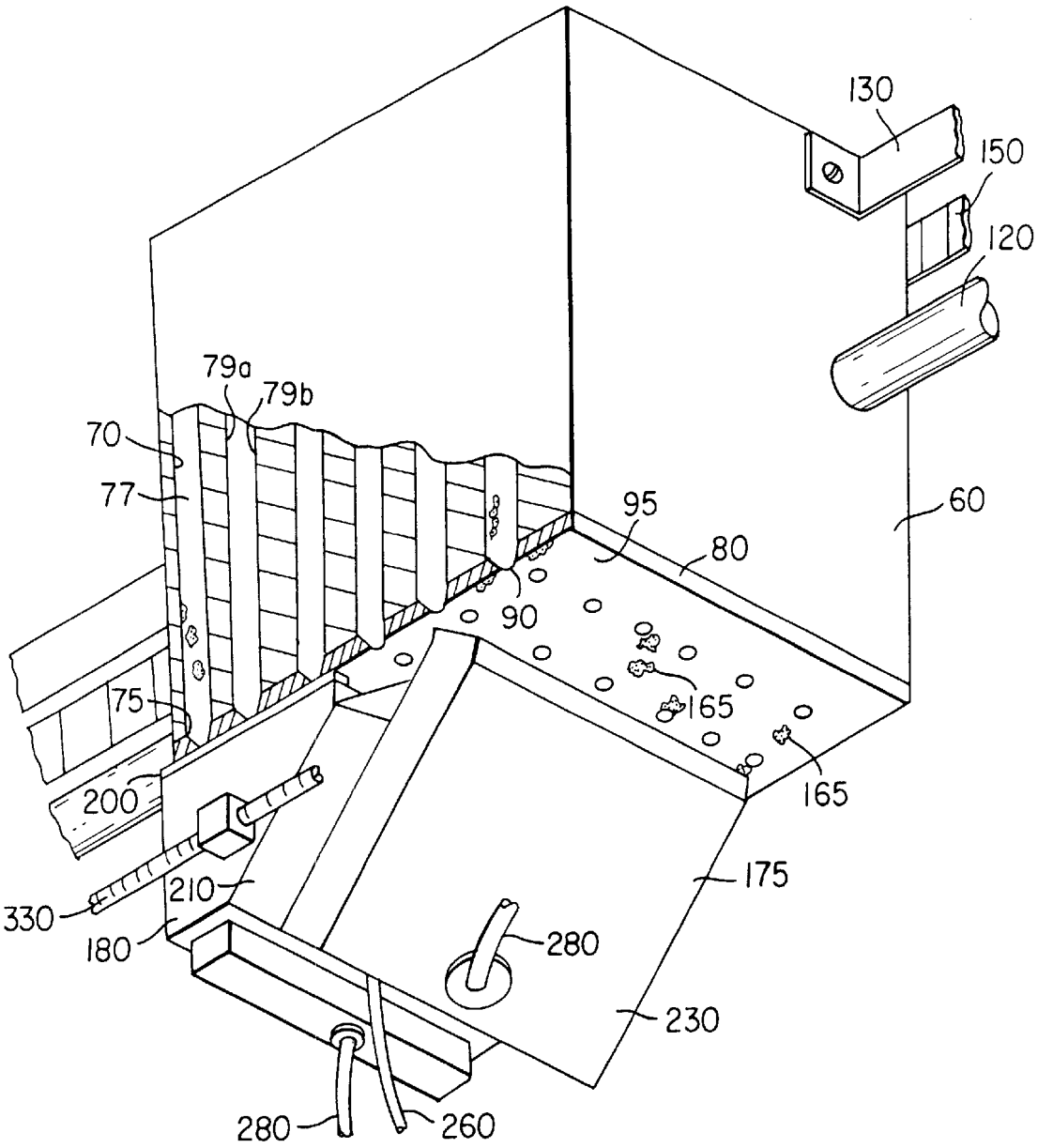
FIG. 6 is a view in perspective of a first embodiment cleaning block belonging to the cleaning mechanism, the first embodiment cleaning block here shown cleaning the print head.
Figure 7:
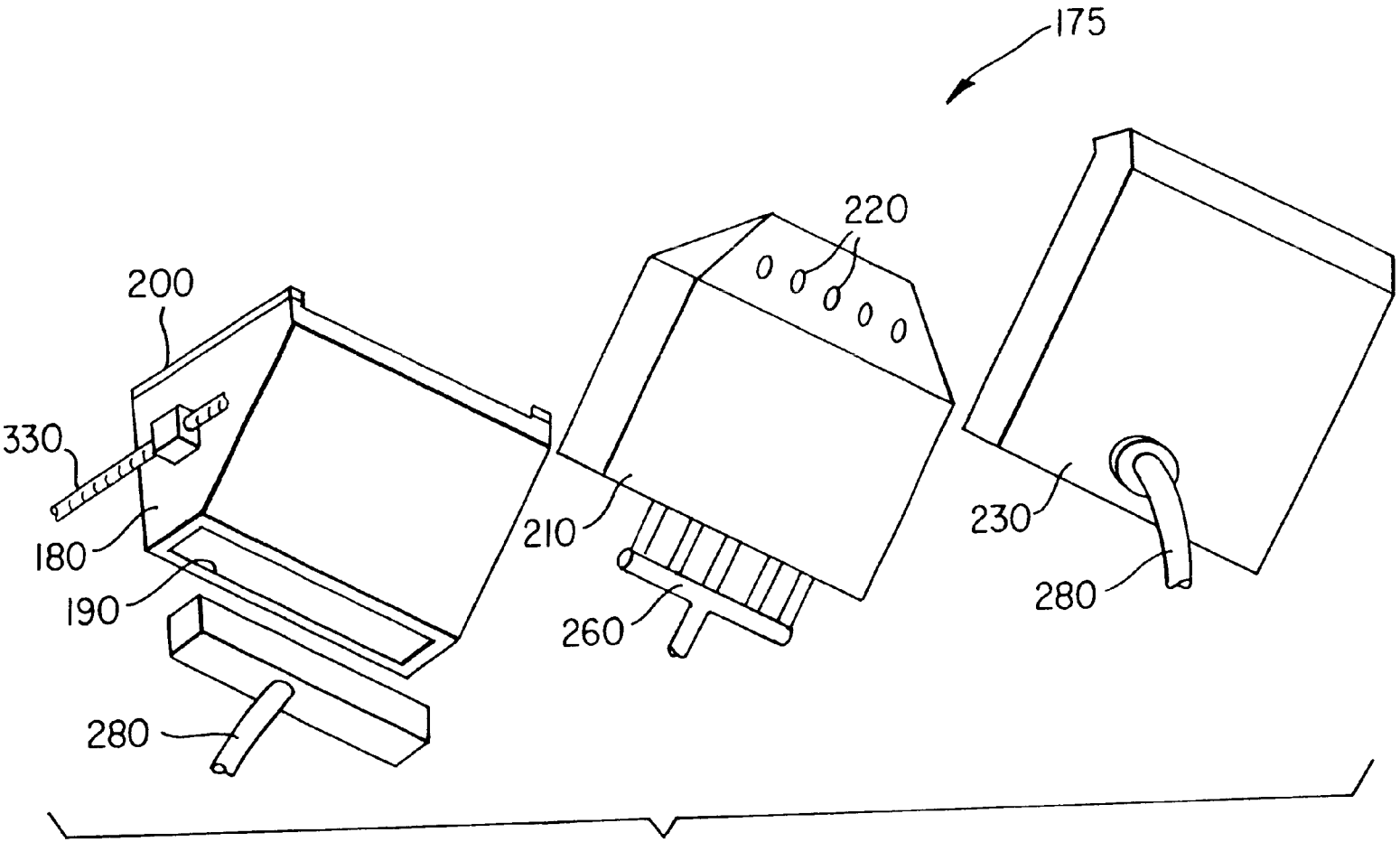
FIG. 7 is an exploded view of the cleaning block.

Referring now to FIGS. 2, 3 and 5, platen roller 40 is disposed adjacent to print head 60 and, unless appropriate steps are taken, will interfere with displacing cleaning block 175 to a position proximate surface 95. Therefore, it is desirable to move platen roller 40 out of interference with cleaning block 175, so that cleaning block 175 can be displaced proximate surface 95. Therefore, according to the first embodiment of printer 10, platen roller 40 is pivoted outwardly about previously mentioned pivot shaft 57 along arc 59. After platen roller 40 has been pivoted, displacement mechanism 350 is operated to displace cleaning block 175 to a position proximate surface 95 to begin removal of particulate matter 165 from ink channel 70 and surface 95.

Figure 9:
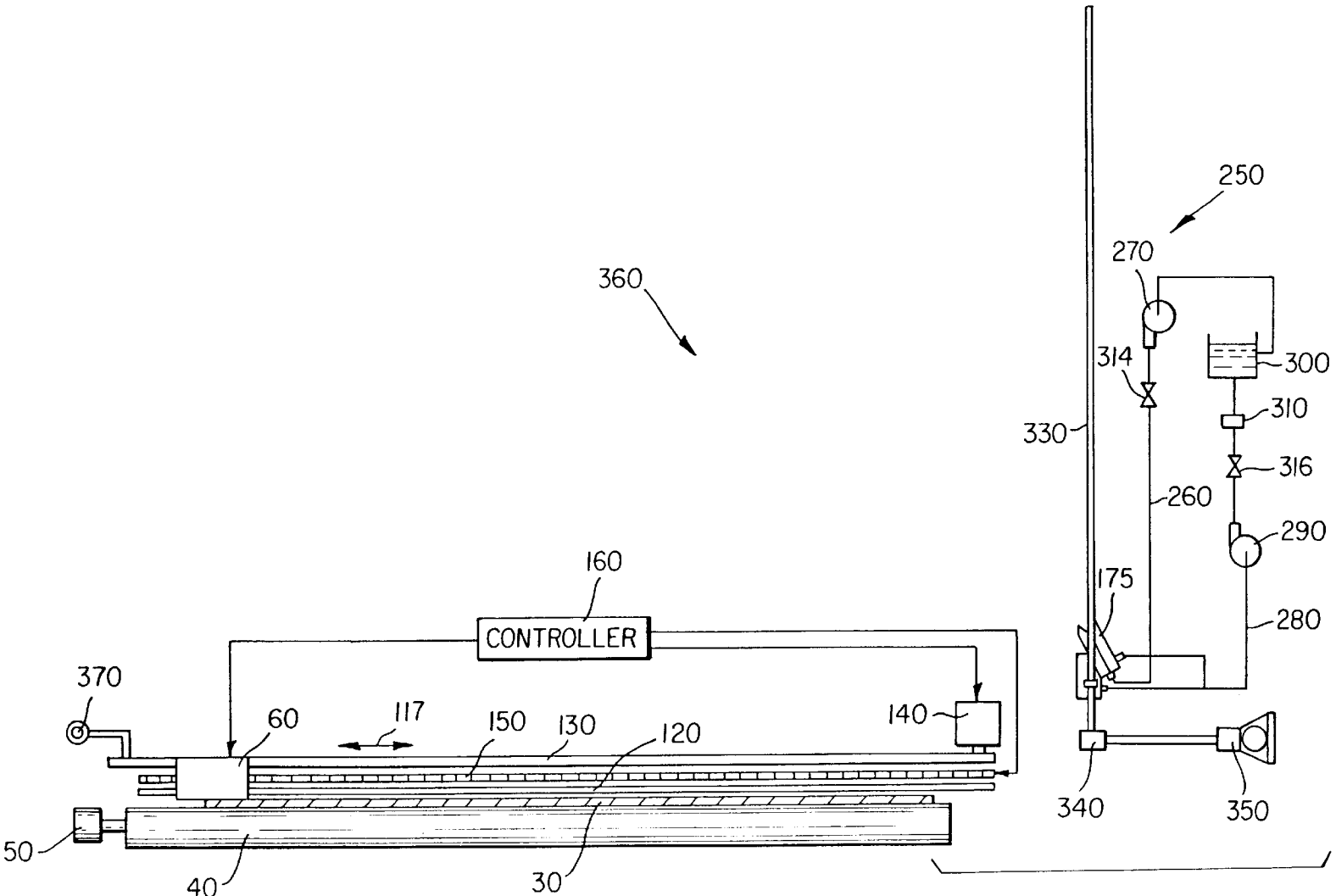
FIG. 9 is a view in elevation of a second embodiment ink jet printer, this view showing the cleaning mechanism disposed in an upright position and poised to move to a location adjacent the print head to clean the print head, which print head is capable of being pivoted into an upright position.
Figure 10:
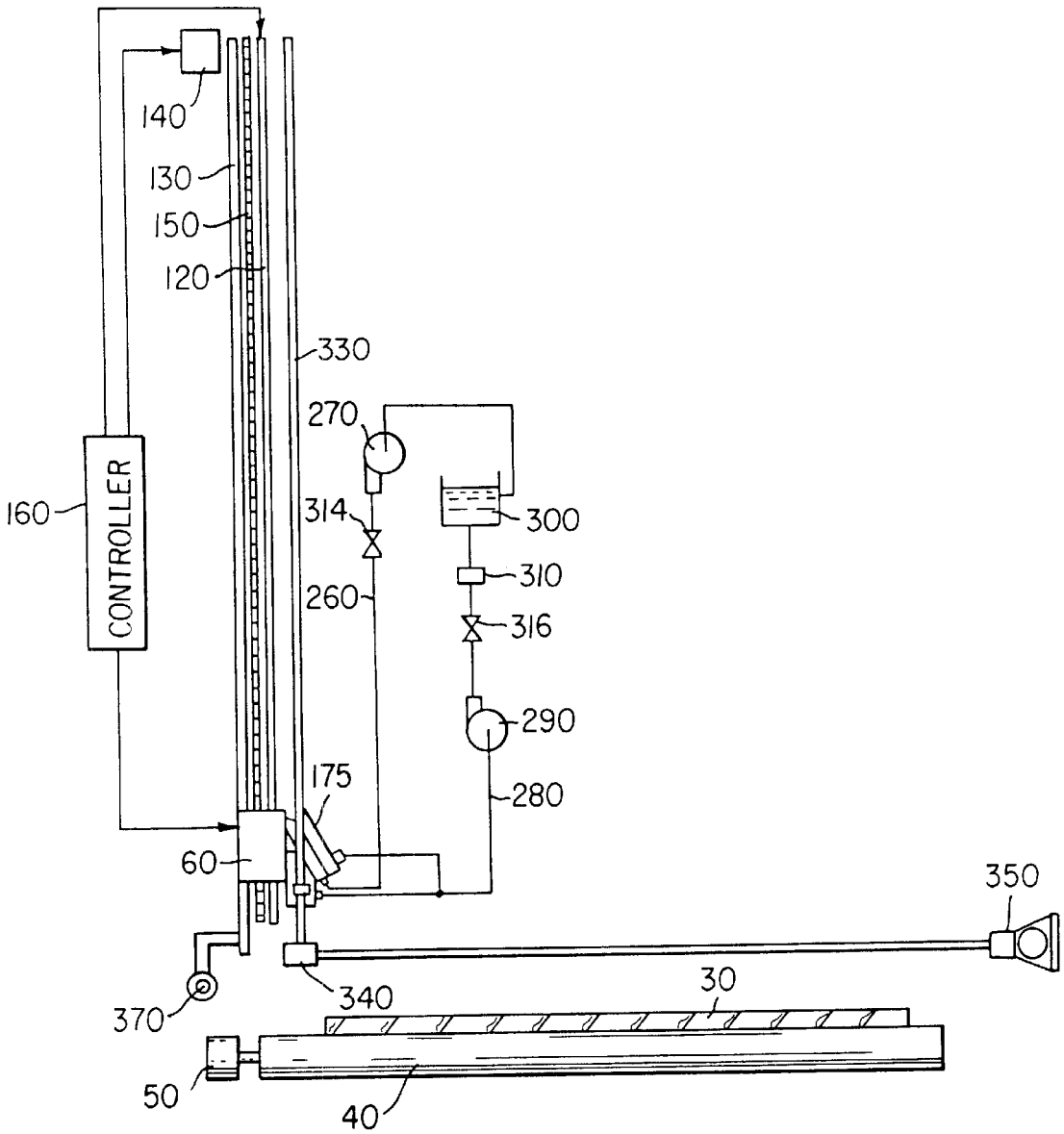
FIG. 10 is a view in elevation of the second embodiment printer, this view showing the cleaning mechanism having been moved into position to clean the print head which has been pivoted into an upright position.

Turning now to FIGS. 9 and 10, there is shown a second embodiment ink jet printer 360 capable of simultaneously removing particulate matter 165 from ink channel 70 and surface 95. Second embodiment ink jet printer 360 is substantially similar to first embodiment ink jet printer 10, except that platen roller 40 is fixed (i.e., non-pivoting). Also, according to this second embodiment printer, print head 60 pivots about a pivot pin 370 to an upright position (as shown). Moreover, cleaning mechanism 170 is oriented in an upright position (as shown) and displacement mechanism 350 displaces cleaning block 175, so that cleaning block is moved to a location proximate surface 95 while print head 60 is in its upright position.

Figure 11:
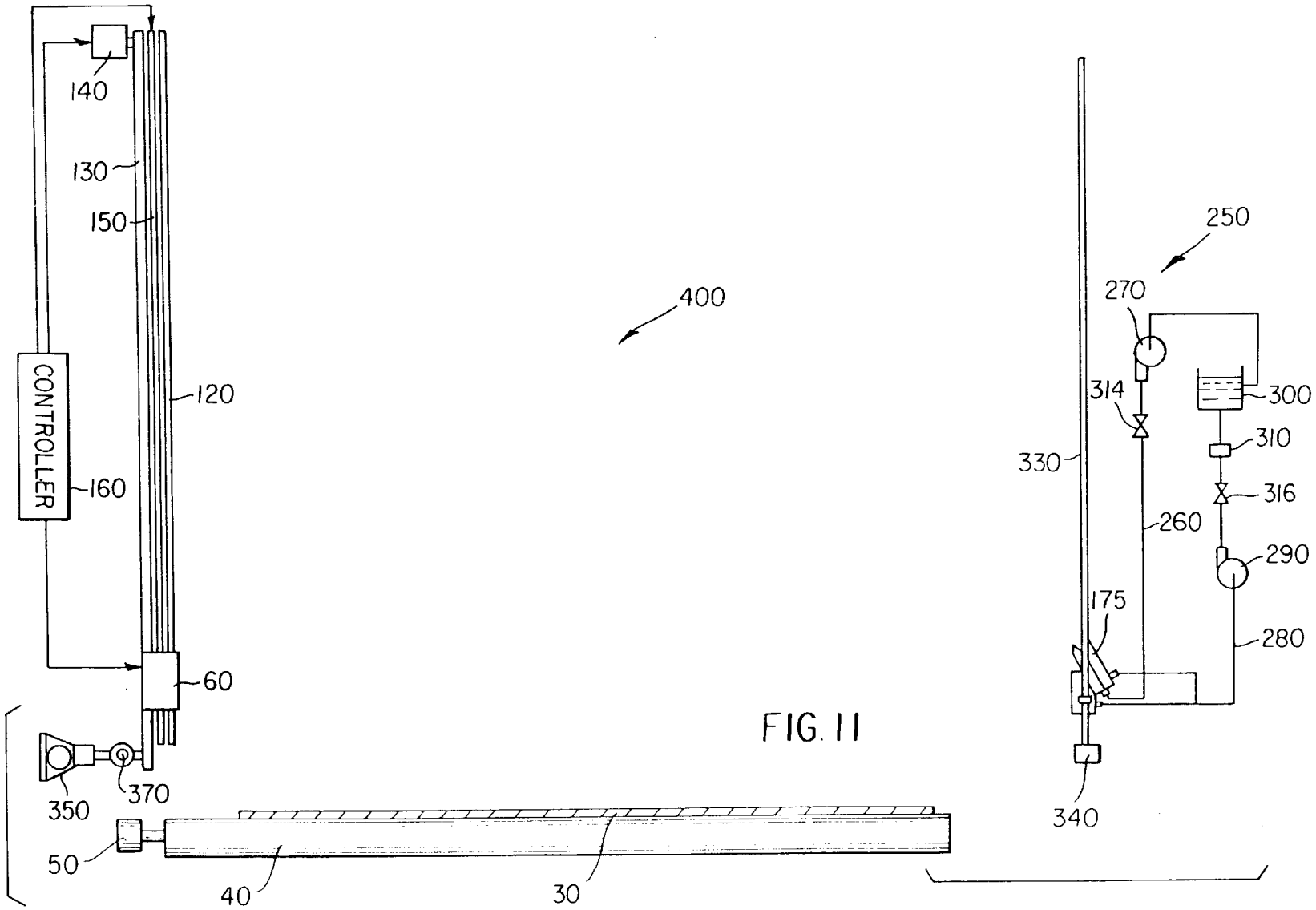
FIG. 11 is a view in elevation of a third embodiment ink jet printer, this view showing the print head pivoted into an upright position and poised to move to a location adjacent the upright cleaning mechanism to clean the print head.
Figure 12:
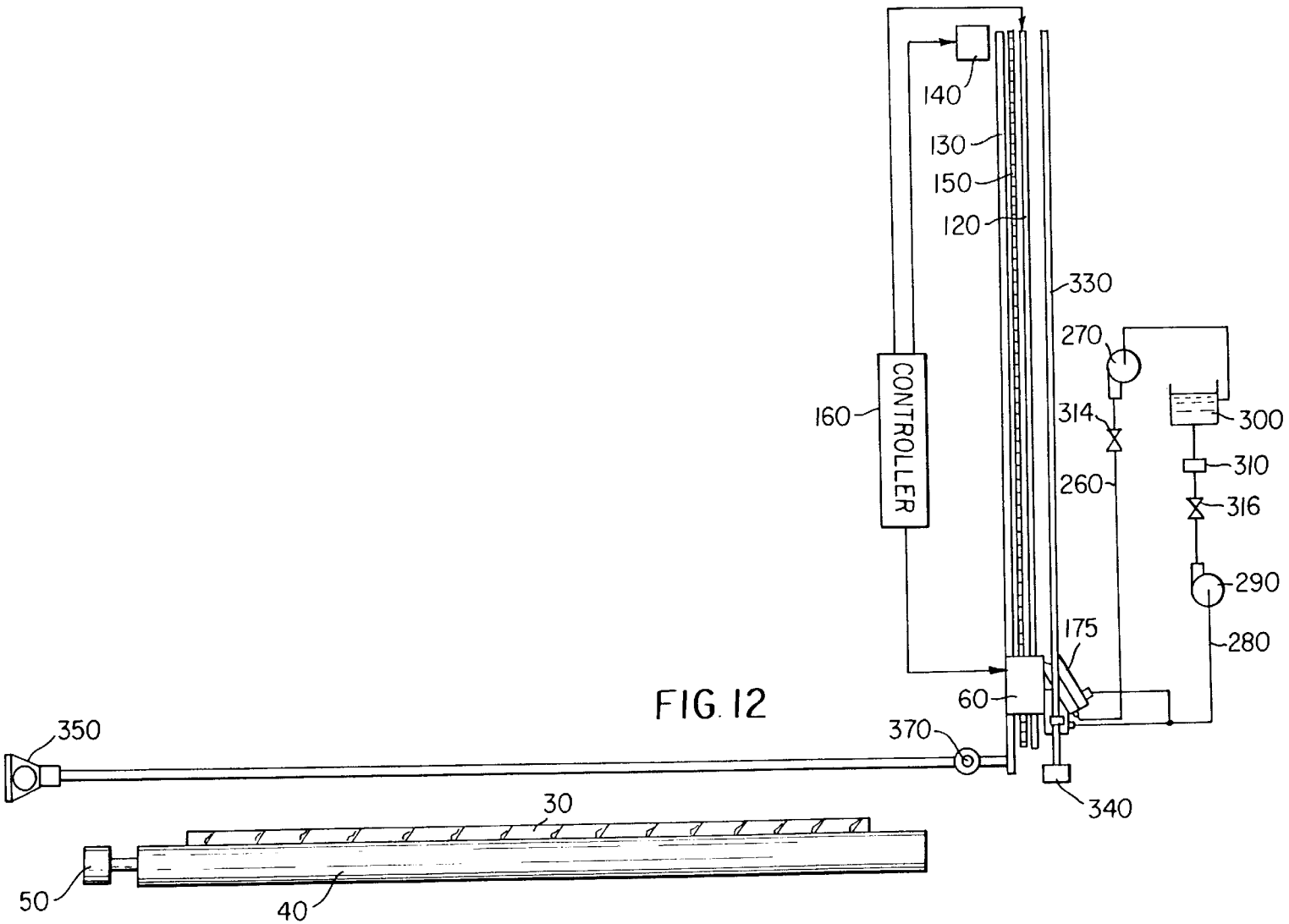
FIG. 12 is a view in elevation of the third embodiment printer, this view showing the print head having been moved into position to clean the print head.

Referring to FIGS. 11 and 12, there is shown a third embodiment ink jet printer 400 capable of simultaneously removing particulate matter 165 from ink channel 70 and surface 95. Third embodiment ink jet printer 400 is substantially similar to first embodiment ink jet printer 10, except that platen roller 40 is fixed (i.e., non-pivoting). Also, according to this third embodiment printer, print head 60 pivots about pivot pin 370 to an upright position (as shown) and displacement mechanism 350 displaces printer 400 (except for platen roller 40), so that printer 400 is moved to a location proximate cleaning mechanism 170. Moreover, cleaning mechanism 170 is oriented in a fixed upright position (as shown).

Figure 13:
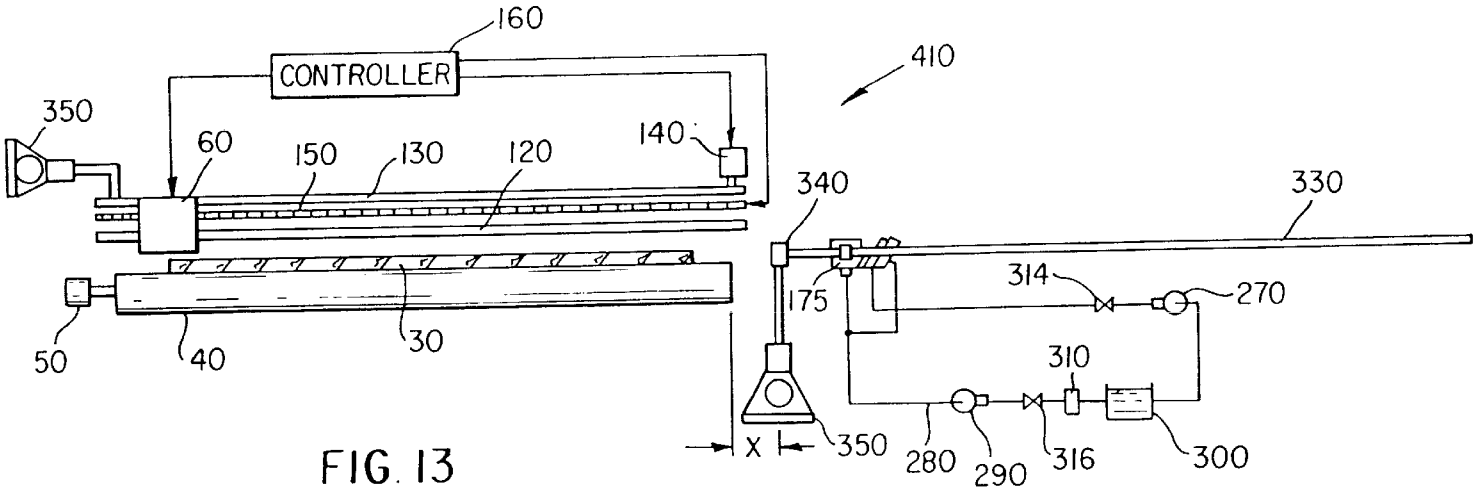
FIG. 13 is a view in elevation of a fourth embodiment ink jet printer, this view showing the print head in a horizontal position and poised to move laterally to a location adjacent the cleaning mechanism to clean the print head.
Figure 14:
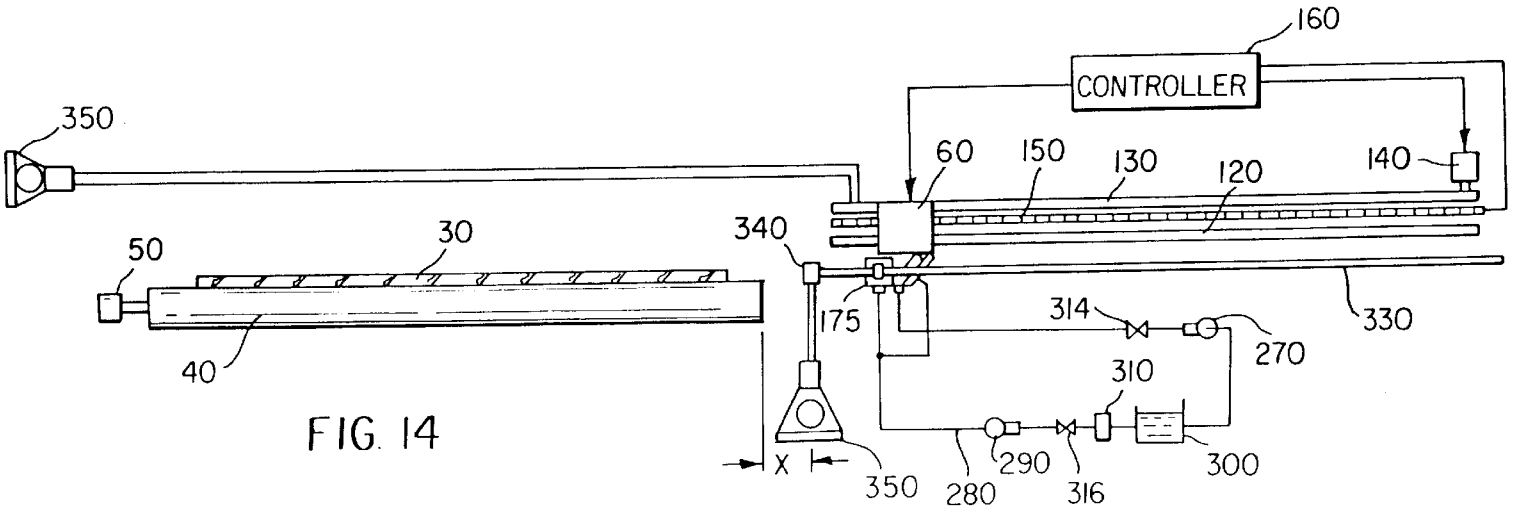
FIG. 14 is a view in elevation of the fourth embodiment printer, this view showing the print head having been moved into position to clean the print head.

Referring to FIGS. 13 and 14, there is shown a fourth embodiment ink jet printer 410 capable of simultaneously removing particulate matter 165 from ink channel 70 and surface 95. Fourth embodiment ink jet printer 410 is substantially similar to first embodiment ink jet printer 10, except that platen roller 40 is fixed (i.e., non-pivoting) and cleaning assembly 170 is off-set from an end portion of platen roller 40 by a distance "X". Also, according to this third embodiment printer, displacement mechanism 350 displaces printer 410 (except for platen roller 40), so that printer 410 is moved to a location proximate cleaning mechanism 170.

Figure 15:
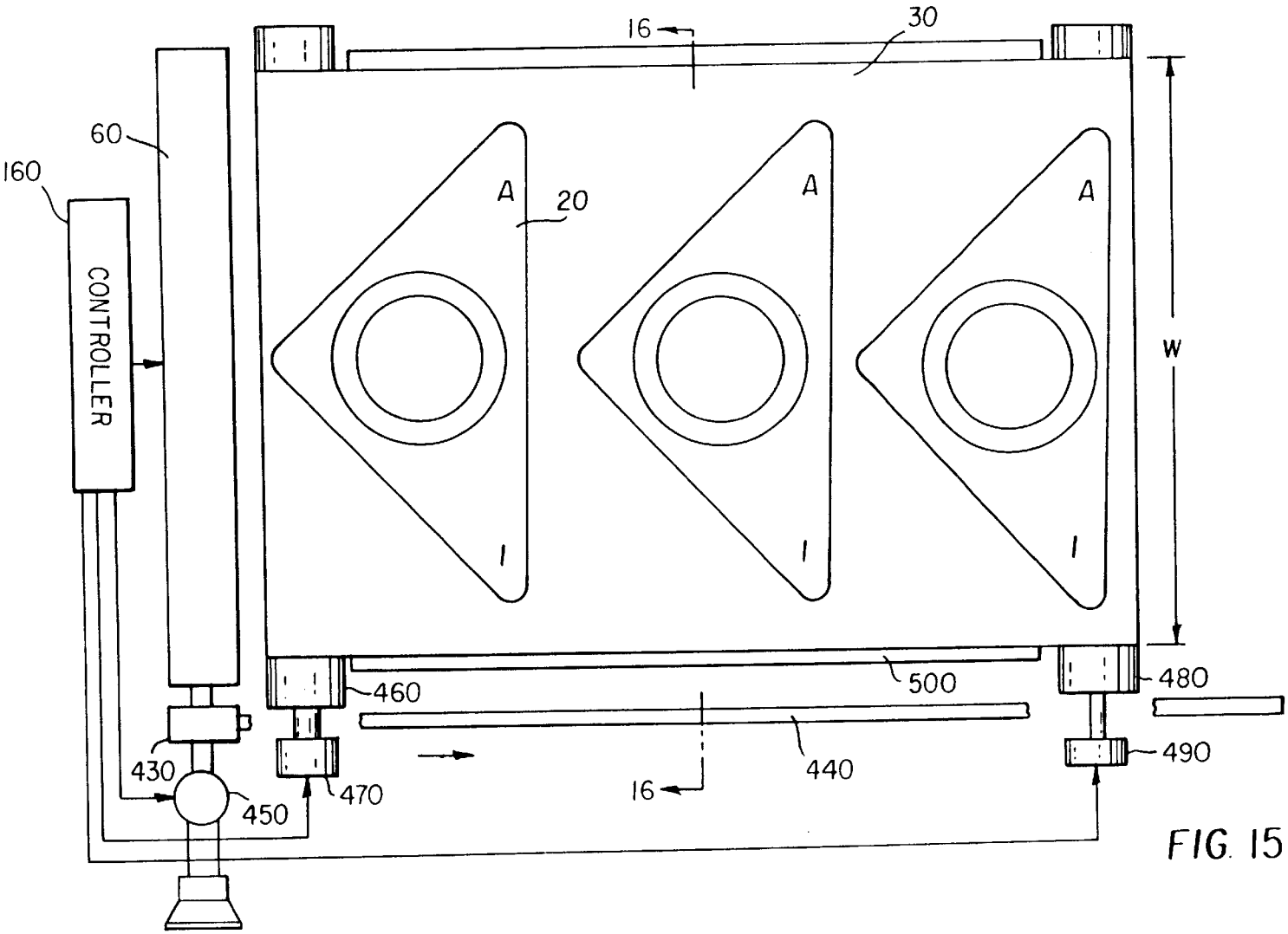
FIG. 15 is a view in plan of a fifth embodiment ink jet printer, the printer having a non-reciprocating "page-width" print head.
Figure 16:
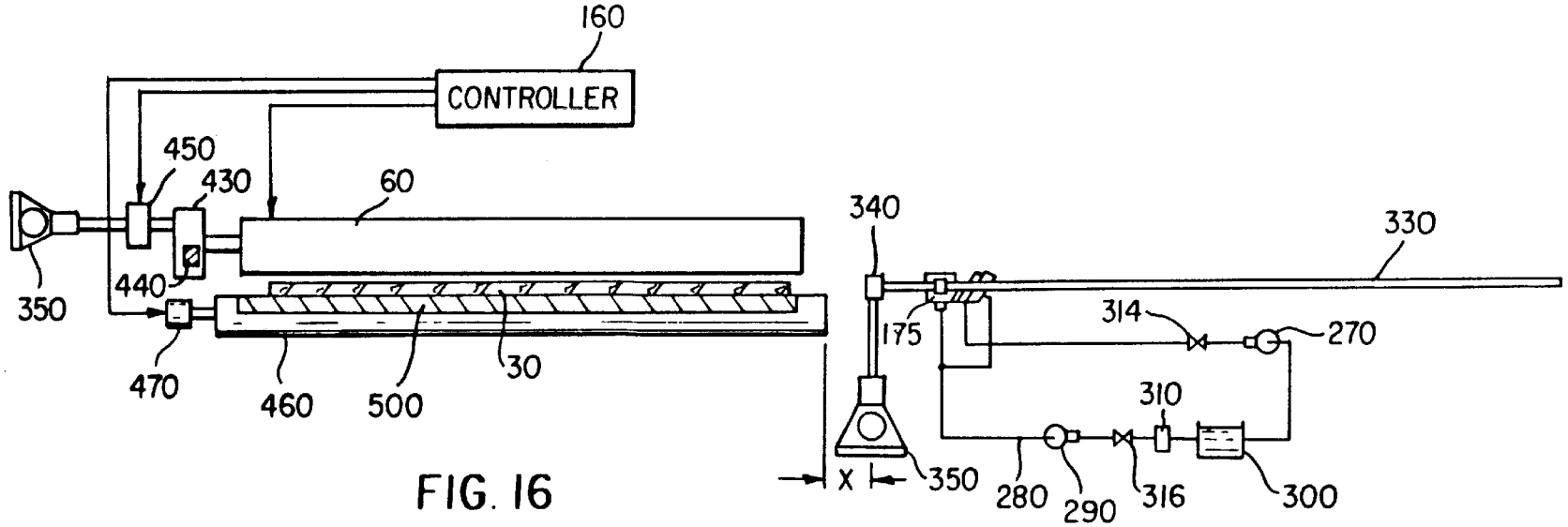
FIG. 16 is a view taken along section line 16—16 of FIG. 15, this view showing the print head in a horizontal position and poised to move laterally to a location adjacent the cleaning mechanism to clean the print head.
Figure 17:
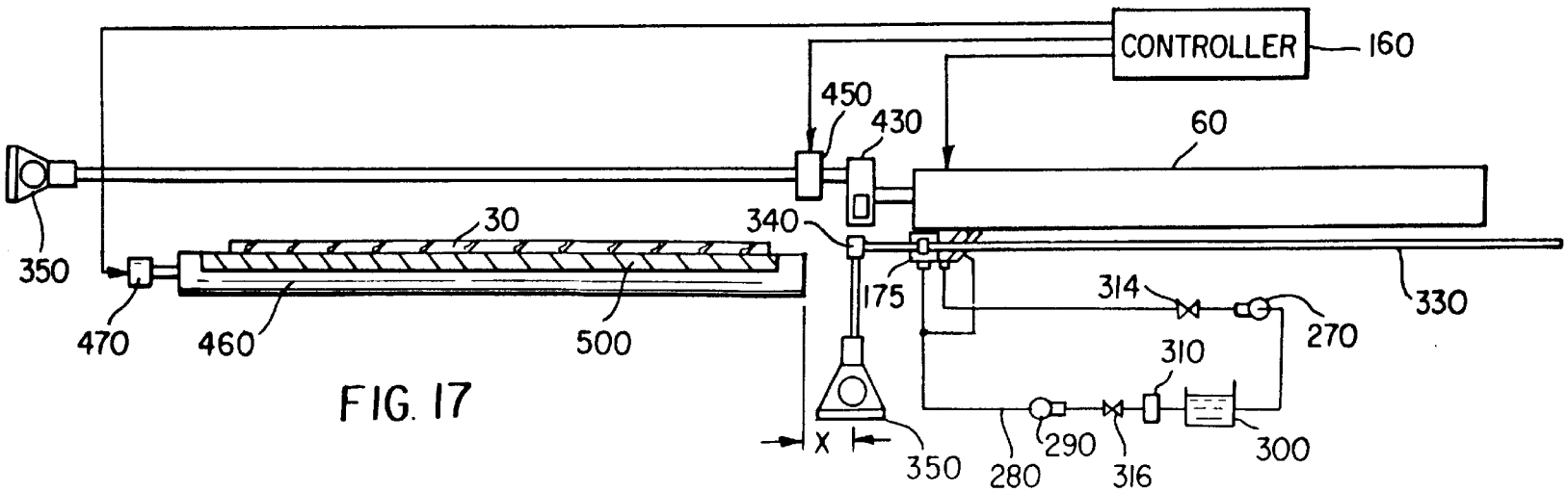
FIG. 17 is a view in elevation of the fifth embodiment printer, this view showing the print head having been moved into position to clean the print head.

Referring to FIGS. 15, 16 and 17, there is shown a fifth embodiment ink jet printer, generally referred to as 420, for printing image 20 on receiver 30. Fifth embodiment printer 420 is a so-called "page-width" printer capable of printing across width W of receiver 30 without reciprocating across width W. That is, printer 420 comprises print head 60 of length substantially equal to width W. Connected to print head 60 is a carriage 430 adapted to carry print head 60 in direction of first arrow 55. In this regard, carriage 430 slidably engages an elongate slide member 440 extending parallel to receiver 30 in direction of first arrow 55. A print head drive motor 450 is connected to carriage 430 for operating carriage 430, so that carriage 430 slides along slide member 440 in direction of first arrow 55. As carriage 430 slides along slide member 440 in direction of first arrow 55, print head 60 also travels in direction of first arrow 55 because print head 60 is connected to carriage 430. In this manner, print head 60 is capable of printing a plurality of images 20 (as shown) in a single printing pass along length of receiver 30. In addition, a first feed roller 460 engages receiver 30 for feeding receiver 30 in direction of first arrow 55 after all images 20 have been printed. In this regard, a first feed roller motor 470 engages first feed roller 460 for rotating first feed roller 460, so that receiver 30 feeds in direction of first arrow 55. Further, a second feed roller 480, spaced-apart from first feed roller 460, may also engage receiver 30 for feeding receiver 30 in direction of first arrow 55. In this case, a second feed roller motor 490, synchronized with first feed roller motor 470, engages second feed roller 480 for rotating second feed roller 480, so that receiver 30 smoothly feeds in direction of first arrow 55. Interposed between first feed roller 460 and second feed roller 480 is a support member, such as a stationary flat platen 500, for supporting receiver 30 thereon as receiver feeds from first feed roller 460 to second feed roller 480. Of course, previously mentioned controller 160 is connected to print head 60, print head drive motor 450, first feed roller motor 470 and second feed roller motor 490 for controlling operation thereof in order to suitably form images 20 on receiver 30.

Still referring to FIGS. 15, 16 and 17, according to this fifth embodiment printer 420, displacement mechanism 350 displaces printer 410 (except for feed rollers 460/480 and platen 500), so that printer 410 is moved to a location proximate cleaning mechanism 170.

The solvent cleaning agent mentioned hereinabove may be any suitable liquid solvent composition, such as water, isopropanol, diethylene glycol, diethylene glycol monobutyl ether, octane, acids and bases, surfactant solutions and any combination thereof. Complex liquid compositions may also be used, such as microemulsions, micellar surfactant solutions, vesicles and solid particles dispersed in the liquid.

It may be understood from the teachings hereinabove, that an advantage of the present invention is that cleaning time is reduced. This is so because surface 95 of print head 60 is cleaned of contaminant simultaneously with cleaning ink channels 70 formed in the print head 60.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, with respect to the second embodiment printer 360, displacement mechanism 350 may be foldable to the upright position from a substantially horizontal position. This configuration of the invention will minimize the external envelope of printer 360 when print head 60 is not being cleaned by cleaning mechanism 170, so that printer 360 can be located in a confined space with limited headroom.

Therefore, what is provided is an ink jet printer with cleaning mechanism, and method of assembling same, which cleaning mechanism is capable of simultaneously cleaning the print head surface and ink channels.

PARTS LIST

10 . . . first embodiment ink jet printer

20 . . . image

30 . . . receiver

40 . . . platen roller
50 . . . platen roller motor
55 . . . first arrow
57 . . . pivot shaft
59 . . . arc
60 . . . print head
70 . . . ink channel
75 . . . ink channel outlet
77 . . . ink body
79*a*/*b* . . . side walls
80 . . . cover plate
90 . . . orifice
95 . . . surface
100 . . . ink droplet
105 . . . preferred axis of ink droplet ejection
110 . . . transport mechanism
115*a* . . . first position (of print head)
115*b* . . . second position (of print head)
117 . . . second arrow
120 . . . guide rail
130 . . . drive belt
140 . . . drive belt motor
150 . . . encoder strip
160 . . . controller
165 . . . particulate matter
167 . . . non-preferred axis of ink droplet ejection
170 . . . cleaning mechanism
175 . . . first embodiment cleaning block
180 . . . vacuum hood
190 . . . first passageway
195 . . . edge (of vacuum hood)
200 . . . seal
210 . . . solvent delivering wiper
220 . . . second passageway
225 . . . blade portion
227 . . . third arrow
230 . . . vacuum canopy
240 . . . third passageway
242 . . . second embodiment cleaning block
244 . . . solvent delivering squeegee
246 . . . wiper portion
250 . . . piping circuit
260 . . . first piping segment
270 . . . discharge pump
280 . . . second piping segment
290 . . . vacuum pump
300 . . . reservoir
310 . . . filter
314 . . . first valve
316 . . . second valve
320 . . . translation mechanism
330 . . . lead-screw
340 . . . motor
345 . . . fourth arrow
350 . . . displacement mechanism
360 . . . second embodiment ink jet printer
370 . . . pivot pin
400 . . . third embodiment ink jet printer
410 . . . embodiment ink jet printer
420 . . . fifth embodiment ink jet printer
430 . . . carriage
440 . . . slide member
450 . . . print head drive motor
460 . . . first feed roller
470 . . . first feed roller motor
480 . . . second feed roller
490 . . . second feed roller motor
500 . . . stationary platen

What is claimed is:

1. An ink jet printer, comprising:

(a) a print head having a surface thereon and an ink channel therein; and (b) a cleaning mechanism associated with said print head and adapted to simultaneously clean contaminant from the surface and the ink channel.

2. The printer of claim 1, wherein said cleaning mechanism comprises a vacuum pump capable of being coupled to the ink channel for vacuuming contaminant from the ink channel.

3. The printer of claim 2, wherein said cleaning mechanism comprises:

(a) a solvent delivering wiper alignable with the surface for delivering a cleaning agent to the surface to flush contaminant from the surface; and (b) a vacuum pump capable of being disposed adjacent to the surface for vacuuming contaminant flushed from the surface.

4. An ink jet printer, comprising:

(a) a print head having a surface thereon surrounding an orifice in communication with an ink channel formed in said print head;

(b) a cleaning block capable of surrounding the orifice and having a first passageway in communication with the orifice for vacuuming contaminant from the ink channel, said cleaning block having a second passageway alignable with the surface for delivering a cleaning agent to the surface to flush contaminant from the surface, said cleaning block having a third passageway alignable with the surface for vacuuming the cleaning agent and contaminant from the surface; and (c) a circulation circuit connected to said cleaning block for circulating the cleaning agent through said cleaning block, said circulation circuit including a vacuum pump capable of being coupled to the first passageway for inducing negative pressure in the first passageway and capable of being coupled to the third passageway for inducing negative pressure in the third passageway, whereby contaminant is vacuumed from the ink channel while negative pressure is induced in the first passageway and whereby the cleaning agent and contaminant are vacuumed from the surface while negative pressure is induced in the third passageway.

5. The printer of claim 4, wherein said circuit comprises a discharge pump coupled to the second passageway for discharging the cleaning agent into the second passageway, whereby the cleaning agent is delivered to the surface while said discharge pump discharges the cleaning agent into the second passageway.

6. The printer of claim 4, further comprising:

(a) a platen associated with said print head for supporting a receiver to be printed on by said print head; and (b) a pivot shaft connected to said platen for pivoting said platen about said pivot shaft.

7. The printer of claim 4, further comprising a translation mechanism connected to said cleaning block for translating said cleaning block across said print head.

8. The printer of claim 4, further comprising a displacement mechanism connected to said cleaning block for displacing said cleaning block to a position proximate the surface of said print head.

9. The printer of claim 4, further comprising a displacement mechanism connected to said print head for displacing said print head to a position proximate said cleaning block.

10. An ink jet printer, comprising:

(a) a print head having a surface thereon surrounding a plurality of ink ejection orifices in communication with respective ones of a plurality of ink channels formed in said print head;

(b) a cleaning block associated with said print head for cleaning said print head, said cleaning block including:

(i) a vacuum hood capable of sealingly surrounding at least one of the orifices and having a first passageway formed therethrough in communication with the at least one orifice;

(ii) a solvent delivering wiper connected to said hood and having a second passageway formed therethrough alignable with the surface for delivering a liquid solvent to the surface to flush particulate matter from the surface, whereby particulate matter residing on the surface is entrained in the solvent while said wiper flushes particulate matter from the surface; and (iii) a vacuum canopy connected to said canopy and having a third passageway formed therethrough alignable with the surface to vacuum solvent and entrained particulate matter from the surface; and (c) a piping circuit associated with said print head, said piping circuit including:

(i) a first piping segment coupled to the second passageway formed through said wiper;

(ii) a discharge pump connected to said first piping segment for discharging the solvent into the first piping segment, whereby the solvent discharges into the second passageway while the discharge pump discharges the solvent into the first piping segment;

(iii) a second piping segment coupled to the first passageway formed through said hood and the third passageway formed through said canopy; and (iv) a vacuum pump connected to said second piping segment for inducing negative pressure in said second piping segment, whereby negative pressure is simultaneously induced in the first passageway and the third passageway while said vacuum pump induces negative pressure in said second piping segment, whereby particulate matter is vacuumed through the at least one orifice and respective ink channel while negative pressure is induced in the first passageway and whereby the solvent and entrained particulate matter are vacuumed from the surface while negative pressure is induced in the third passageway.

11. The printer of claim 10, further comprising:

(a) a platen associated with said print head for supporting a receiver to be printed on by said print head; and (b) a pivot shaft connected to said platen for pivoting said platen about said pivot shaft.

12. The printer of claim 10, further comprising a translation mechanism connected to said cleaning block for translating said cleaning block across the surface of said print head.

13. The printer of claim 12, wherein said translation mechanism comprises a lead-screw threadably engaging said cleaning block.

14. The printer of claim 10, further comprising a displacement mechanism connected to said cleaning block for displacing said cleaning block into sealing engagement with the surface of said print head.

15. The printer of claim 10, further comprising a displacement mechanism connected to said print head for displacing said print head into contact with said cleaning block.

16. The printer of claim 10, wherein said piping circuit comprises a solvent supply reservoir connected to said discharge pump for supplying the solvent to said discharge pump.

17. The printer of claim 10, wherein said piping circuit comprises a filter coupled to said vacuum pump for capturing contaminant vacuumed from the ink channel and the surface by said vacuum pump.

18. A cleaning mechanism for cleaning an ink jet print head having a surface thereon and an ink channel therein, comprising:

(a) a vacuum pump capable of being coupled to the ink channel for vacuuming contaminant from the ink channel;

(b) a solvent delivering wiper alignable with the surface for delivering a cleaning agent to the surface to flush contaminant from the surface; and (c) a vacuum pump capable of being coupled to the surface for vacuuming contaminant flushed from the surface.

19. A cleaning mechanism for cleaning an ink jet print head having a surface having contaminant thereon and an ink channel having contaminant therein, the ink channel terminating in an orifice on the surface, comprising:

(a) a hood capable of sealingly surrounding the orifice and having a first passageway in communication with the orifice;

(b) a vacuum pump capable of being coupled to the first passageway for inducing negative pressure in the first passageway, whereby negative pressure is induced in the ink channel by way of the orifice while said vacuum pump induces negative pressure in the first passageway and whereby particulate matter is vacuumed from the ink channel by way of the orifice while negative pressure is induced in the ink channel;

(c) a solvent delivering wiper disposed near said hood and having a second passageway alignable with the surface for delivering a liquid solvent to the surface to flush particulate matter from the surface; and (d) a canopy disposed near said wiper and having a third passageway alignable with the surface for vacuuming the solvent and particulate matter from the surface, the third passageway coupled to said vacuum pump for inducing negative pressure in the third passageway, whereby the solvent and particulate matter are vacuumed from the surface while said vacuum pump induces negative pressure in the third passageway.

20. A method of assembling an ink jet printer, comprising the steps of:

(a) providing a print head having a surface thereon and an ink channel therein; and (b) providing a cleaning mechanism associated with the print head and adapted to simultaneously clean contaminant from the surface and the ink channel.

21. The method of claim 20, wherein the step of providing a cleaning mechanism comprises the step providing a vacuum pump capable of being coupled to the ink channel for vacuuming contaminant from the ink channel.

22. The method of claim 21, wherein the step of providing a cleaning mechanism comprises the steps of:

(a) providing a solvent delivering wiper alignable with the surface for delivering a cleaning agent to the surface to flush contaminant from the surface; and (b) providing a vacuum pump capable of being disposed adjacent to the surface for vacuuming contaminant flushed from the surface.

23. A method of assembling an ink jet printer, comprising the steps of:

(a) providing a print head having a surface thereon surrounding an orifice in communication with an ink channel formed in the print head;

(b) providing a cleaning block capable of surrounding the orifice and having a first passageway in communication with the orifice for vacuuming contaminant from the ink channel, the cleaning block having a second passageway alignable with the surface for delivering a cleaning agent to the surface to flush contaminant from the surface, the cleaning block having a third passageway alignable with the surface for vacuuming the cleaning agent and contaminant from the surface; and (c) connecting a circulation circuit to the cleaning block for circulating the cleaning agent through the cleaning block, the circulation circuit including a vacuum pump capable of being coupled to the first passageway for inducing negative pressure in the first passageway and capable of being coupled to the third passageway for inducing negative pressure in the third passageway, whereby contaminant is vacuumed from the first passageway while negative pressure is induced in the first passageway and whereby the cleaning agent and contaminant are vacuumed from the surface while negative pressure is induced in the third passageway.

24. The method of claim 23, wherein the step of connecting a circulation circuit comprises the step of coupling a discharge pump to the second passageway for discharging the cleaning agent into the second passageway, whereby the cleaning agent is delivered to the surface while the discharge pump discharges the cleaning agent into the second passageway.

25. The method of claim 23, further comprising the steps of:

(a) providing a platen associated with the print head for supporting a receiver to be printed on by the print head; and (b) connecting a pivot shaft to the platen for pivoting the platen about the pivot shaft.

26. The method of claim 23, further comprising the step of connecting a translation mechanism to the cleaning block for translating the cleaning block across the print head.

27. The method of claim 23, further comprising the step of connecting a displacement mechanism to the cleaning block for displacing the cleaning block to a position proximate the surface of the print head.

28. The method of claim 23, further comprising the step of connecting a displacement mechanism to the print head for displacing the print head to a position proximate the cleaning block.

29. A method of assembling an ink jet printer, comprising the steps of:

(a) providing a print head having a surface thereon surrounding a plurality of ink ejection orifices in communication with respective ones of a plurality of ink channels formed in the print head;

(b) providing a cleaning block associated with the print head for cleaning the print head, the step of providing a cleaning block including the steps of:

(i) providing a vacuum hood capable of sealingly surrounding at least one of the orifices and having a first passageway formed therethrough in communication with the at least one orifice;

(ii) connecting a solvent delivering wiper to the hood, the wiper having a second passageway formed therethrough alignable with the surface for delivering a liquid solvent to the surface to flush particulate matter from the surface, whereby particulate matter residing on the surface is entrained in the solvent while the wiper flushes particulate matter from the surface; and (iii) connecting a vacuum canopy to the wiper, the wiper having a third passageway formed therethrough alignable with the surface to vacuum solvent and entrained particulate matter from the surface; and (c) providing a piping circuit associated with the print head, the step of providing a piping circuit including the steps of:

(i) coupling a first piping segment to the second passageway formed through the wiper;

(ii) connecting a discharge pump to the first piping segment for discharging the solvent into the first piping segment, whereby the solvent discharges into the second passageway while the discharge pump discharges the solvent into the first piping segment;

(iii) coupling a second piping segment to the first passageway formed through the hood and the third passageway formed through the canopy; and (iv) connecting a vacuum pump to the second piping segment for inducing negative pressure in the second piping segment, whereby negative pressure is simultaneously induced in the first passageway and the third passageway while the vacuum pump induces negative pressure in the second piping segment, whereby particulate matter is vacuumed through the at least one orifice and respective ink channel while negative pressure is induced in the first passageway and whereby the solvent and entrained particulate matter are vacuumed from the surface while negative pressure is induced in the third passageway.

30. The method of claim 29, further comprising the steps of:

(a) providing a platen associated with the print head for supporting a receiver to be printed on by the print head; and (b) connecting a pivot shaft to the platen for pivoting the platen about the pivot shaft.

31. The method of claim 29, further comprising the step of connecting a translation mechanism to the cleaning block for translating the cleaning block across the surface of the print head.

32. The method of claim 31, wherein the step of connecting a translation mechanism comprises the step of threadably engaging a lead-screw with the cleaning block.

33. The method of claim 29, further comprising the step of connecting a displacement mechanism to the cleaning block for displacing the cleaning block into sealing engagement with the surface of the print head.

34. The method of claim 29, further comprising the step of connecting a displacement mechanism to the print head for displacing the print head into contact with the cleaning block.

35. The method of claim 29, wherein the step of providing a piping circuit comprises the step of connecting a solvent supply reservoir to the discharge pump for supplying the solvent to the discharge pump.

36. The method of claim 29, wherein the step of providing a piping circuit comprises the step of coupling a filter to the vacuum pump for capturing contaminant vacuumed from the ink channel and the surface by the vacuum pump.

37. A method of assembling a cleaning mechanism for cleaning an ink jet print head having a surface thereon and an ink channel therein, comprising the steps of:

(a) providing a vacuum pump capable of being coupled to the ink channel for vacuuming contaminant from the ink channel;

(b) providing a solvent delivering wiper alignable with the surface for delivering a cleaning agent to the surface to flush contaminant from the surface; and (c) providing a vacuum pump capable of being coupled to the surface for vacuuming contaminant flushed from the surface.

38. A method of assembling a cleaning mechanism for cleaning an ink jet print head having a surface having contaminant thereon and an ink channel having contaminant therein, the ink channel terminating in an orifice on the surface, comprising the steps of:

(a) providing a hood capable of sealingly surrounding the orifice, the hood having a first passageway in communication with the orifice;

(b) coupling a vacuum pump to the first passageway for inducing negative pressure in the first passageway, whereby negative pressure is induced in the ink channel by way of the orifice while the vacuum pump induces negative pressure in the first passageway and whereby particulate matter is vacuumed from the ink channel by way of the orifice while negative pressure is induced in the ink channel;

(c) disposing a solvent delivering wiper near the hood, the wiper having a second passageway alignable with the surface for delivering a liquid solvent to the surface to flush particulate matter from the surface; and (d) disposing a canopy near the wiper, the canopy having a third passageway alignable with the surface for vacuuming the solvent and particulate matter from the surface, the third passageway coupled to the vacuum pump for inducing negative pressure in the third passageway, whereby the solvent and particulate matter are vacuumed from the surface while the vacuum pump induces negative pressure in the third passageway.

* * * * *